US008781355B2

(12) United States Patent
Koishi

(10) Patent No.: US 8,781,355 B2
(45) Date of Patent: Jul. 15, 2014

(54) ELECTRICAL CONTACT, ELECTROPHOTOGRAPHIC PHOTOSENSITIVE DRUM, AND PROCESS CARTRIDGE

(75) Inventor: Isao Koishi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 93 days.

(21) Appl. No.: 13/137,592

(22) Filed: Aug. 29, 2011

(65) Prior Publication Data

US 2012/0093538 A1 Apr. 19, 2012

(30) Foreign Application Priority Data

Aug. 30, 2010 (JP) ..... 2010-192104

(51) Int. Cl.
*G03G 15/00* (2006.01)

(52) U.S. Cl.
USPC ..... 399/90

(58) Field of Classification Search
CPC ..... G03G 21/1867; G03G 21/1652; G03G 2221/166
USPC ..... 399/90, 116, 117, 159
See application file for complete search history.

(56) References Cited

U.S. PATENT DOCUMENTS

| | | | | |
|---|---|---|---|---|
| 6,785,489 | B2 * | 8/2004 | Anderson, II | 399/90 |
| 2009/0226215 | A1 * | 9/2009 | Deguchi | 399/159 |
| 2010/0067946 | A1 * | 3/2010 | Zogg | 399/117 |
| 2011/0116836 | A1 * | 5/2011 | Huang et al. | |

FOREIGN PATENT DOCUMENTS

| | | |
|---|---|---|
| JP | 06-083123 | 3/1994 |

* cited by examiner

*Primary Examiner* — Walter L Lindsay, Jr.
*Assistant Examiner* — Milton Gonzalez
(74) *Attorney, Agent, or Firm* — Fitzpatrick, Cella, Harper & Scinto

(57) ABSTRACT

An electrical contact member electrically connects to an external contact which is electrically connected with an electroconductive cylindrical member having a photosensitive layer on its outer surface and which is provided outside the cylindrical member. The electrical contact member includes a first contact portion contacted with the cylindrical member, a second contact portion contacted with the external contact, a first extension connected electrically with the first contact portion and extending in a diametrical direction across an axis of the cylindrical member, and a second extension electrically connecting with the first extension and extending in the diametrical direction toward the axis. The second extension is provided with the second contact portion, and when the second contact portion is contacted by the external contact, the second contact portion displaces along the axis.

36 Claims, 15 Drawing Sheets

ELECTRICAL CONTACT, ELECTROPHOTOGRAPHIC PHOTOSENSITIVE DRUM, AND PROCESS CARTRIDGE

FIELD OF THE INVENTION AND RELATED ART

The present invention relates to an electrical connector, an electrophotographic photosensitive drum, and a process cartridge having an electrophotographic photosensitive drum.

An electrophotographic image forming apparatus to which the present invention relates is an apparatus which forms an image on recording medium (ordinary paper, OHP sheet, and the like, for example) with the use of an electrophotographic image formation method. Examples of an electrophotographic image forming apparatus include an electrophotographic copying machine, an electrophotographic printer (laser beam printer, LED printer, and the like, for example), and a facsimile machine.

A process cartridge to which the present invention relates is a cartridge in which an electrophotographic photosensitive drum, and at least one processing means, more specifically, a charging means, a developing means, or a cleaning means, are integrally contained, and which is removably mountable in the main assembly of an electrophotographic image forming apparatus.

An electrophotographic image forming apparatus has been known to have an electrophotographic photosensitive drum, and one or more processing devices, such as a charging device, an exposing device, a cleaning device, etc., which are in the adjacencies of the peripheral surface of the photosensitive drum. Further, an electrophotographic photosensitive drum has been known to be structured to release its residual charge to the main assembly of an image forming apparatus. One of the inventions related to the structural arrangement for this technology is disclosed in Japanese Laid-open Patent Application H06-083123.

The image forming apparatus disclosed in Japanese Laid-open Patent Application H06-08123 has an electrophotographic photosensitive drum, which is made up of an electrically conductive cylindrical member (drum), and an electrophotographic photosensitive layer which covers the peripheral surface of the cylindrical member. The electrically conductive cylinder, which hereafter may be referred to simply as a photosensitive drum, has a pair of flanges, which are immovably fitted in the openings of the lengthwise ends of the photosensitive drum, one for one, by being pressed into the openings. Each flange has a shaft-like portion, by which the photosensitive drum is rotationally supported, or a hole through which a shaft for supporting the photosensitive drum is put. Further, one of the flanges is fitted with an electrically conductive member, that is, an electrical connector, which has the first and second portions of contact. The first portion of contact contacts the inward surface of the photosensitive drum, whereas the second portion of contact is electrically in contact with the external electrical connector of a process cartridge, or the main assembly of an electrophotographic image forming apparatus.

It is assumed here that a process cartridge is structured so that a photosensitive drum is supported by an electrically conductive shaft (drum shaft) which is solidly attached to the frame (shell) of the process cartridge and functions as the abovementioned external electrical connector. In the case of the electrophotographic image forming apparatus disclosed in Japanese Laid-open Patent Application H06-083123, the electrical connector is in the form of a leaf spring, and the second portion of contact of the electrical connector is kept in contact with the inward end of the drum shaft with the application of a present amount of pressure to maintain electrical connection between the electrical connector and drum shaft.

In recent years, however, this setup has become problematic because of the increase in the desire for a small electrophotographic image forming apparatus. In order to reduce an electrophotographic image forming apparatus in size, an electrophotographic image forming apparatus has to be reduced in the size of its main assembly, which in turn requires a process cartridge to be reduced in size. In order to reduce a process cartridge in size, a photosensitive drum, in the adjacencies of which the processing means are placed, has to be reduced in size. In recent years, therefore, a photosensitive drum has been reduced in size, more specifically, in diameter. In order to ensure electrical connection is maintained between the portion (point) of contact of the electrical connector and the end of the shaft of the photosensitive drum, the contact pressure between the portion of contact of the electrical connector and the end of the shaft of the photosensitive drum has to be greater than a certain amount, that is; it cannot be excessively low. Thus, the aforementioned conventional structural arrangement for electrical connection has become problematic for the following reason. That is, with the reduction in the diameter of the cylindrical member of a photosensitive drum, it became difficult to provide an electrical connector for a photosensitive drum, which is structured like the aforementioned conventional electrical connector, and yet, is placeable in a small place, unlikely to suffer from plastic deformation, and stable in electrical connection. Thus, it is necessary to come up with an innovative design for an electrical connection for an electrophotographic photosensitive drum, which makes it possible to place the electrical connector in a smaller space than the space that used to be afforded, and yet, can keep the electrical connector stable in the electrical connection between the electrical connector and the external electrical connector even if the point of contact between the electrical connector and external electrical connector shift in position.

SUMMARY OF THE INVENTION

The present invention is one of the results of the improvement of an electrical connector such as those described above. Thus, the primary object of the present invention is to provide an electrical connector for an electrophotographic photosensitive drum, which is stable in the contact pressure between itself and an external electrical connector, and yet, can be placed inside even the cylindrical member of an electrophotographic photosensitive member, which is significantly smaller in diameter than the cylindrical member of a conventional electrophotographic photosensitive drum.

According to an aspect of the present invention, there is provided an electrical contact member for electrically connecting to an external contact which is electrically connected with an electroconductive cylindrical member having a photosensitive layer on an outer surface thereof and which is provided outside the cylindrical member, said electrical contact member comprising a first contact portion contacted with said cylindrical member; a second contact portion contacted with said external contact; a first extension connected electrically with said first contact portion and extending in a diametrical direction across an axis of said cylindrical member; and a second extension electrically connecting with said first extension and extending in the diametrical direction toward the axis, said second extension being provided with said second contact portion, wherein when second contact portion is contacted by the external contact, second contact portion displaces along the axis.

According to another aspect of the present invention, there is provided an electrophotographic photosensitive drum usable with an electrophotographic image forming apparatus, said electrophotographic photosensitive drum comprising (i) an electroconductive cylindrical member having a photosensitive layer on an outer surface thereof; (ii) an electrical contact member electrically connected with said cylindrical member and electrically connected with an external contact outside said cylindrical member; a first contact portion contacted with said cylindrical member; a second contact portion contacted with said external contact; a first extension connected electrically with said first contact portion and extending in a diametrical direction across an axis of said cylindrical member; and a second extension electrically connecting with said first extension and extending in the diametrical direction toward the axis, said second extension being provided with said second contact portion, wherein when second contact portion is contacted by the external contact, second contact portion displaces along the axis.

According to a further aspect of the present invention, there is provided a process cartridge detachably mountable to an image forming apparatus, said process cartridge comprising an electrophotographic photosensitive drum including, (i) an electroconductive cylindrical member having a photosensitive layer on an outer surface thereof; (ii) an electrical contact member electrically connected with said cylindrical member and electrically connected with an external contact outside said cylindrical member; a first contact portion contacted with said cylindrical member; a second contact portion contacted with said external contact; a first extension connected electrically with said first contact portion and extending in a diametrical direction across an axis of said cylindrical member; and a second extension electrically connecting with said first extension and extending in the diametrical direction toward the axis, said second extension being provided with said second contact portion, wherein when second contact portion is contacted by the external contact, second contact portion displaces along the axis.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention are described in detail with reference to the appended drawings. However, the measurement, material, and shape of each of the structural components of the electrophotographic image forming apparatuses in the preferred embodiments, and the positional relationship among the structural components, are not intended to limit the present invention in scope, unless specifically noted. That is, the present invention is also applicable to various modified versions of the electrophotographic image forming apparatuses and process cartridges therefor, which are modified in structure to accommodate various conditions under which they are operated.

Figure 1:
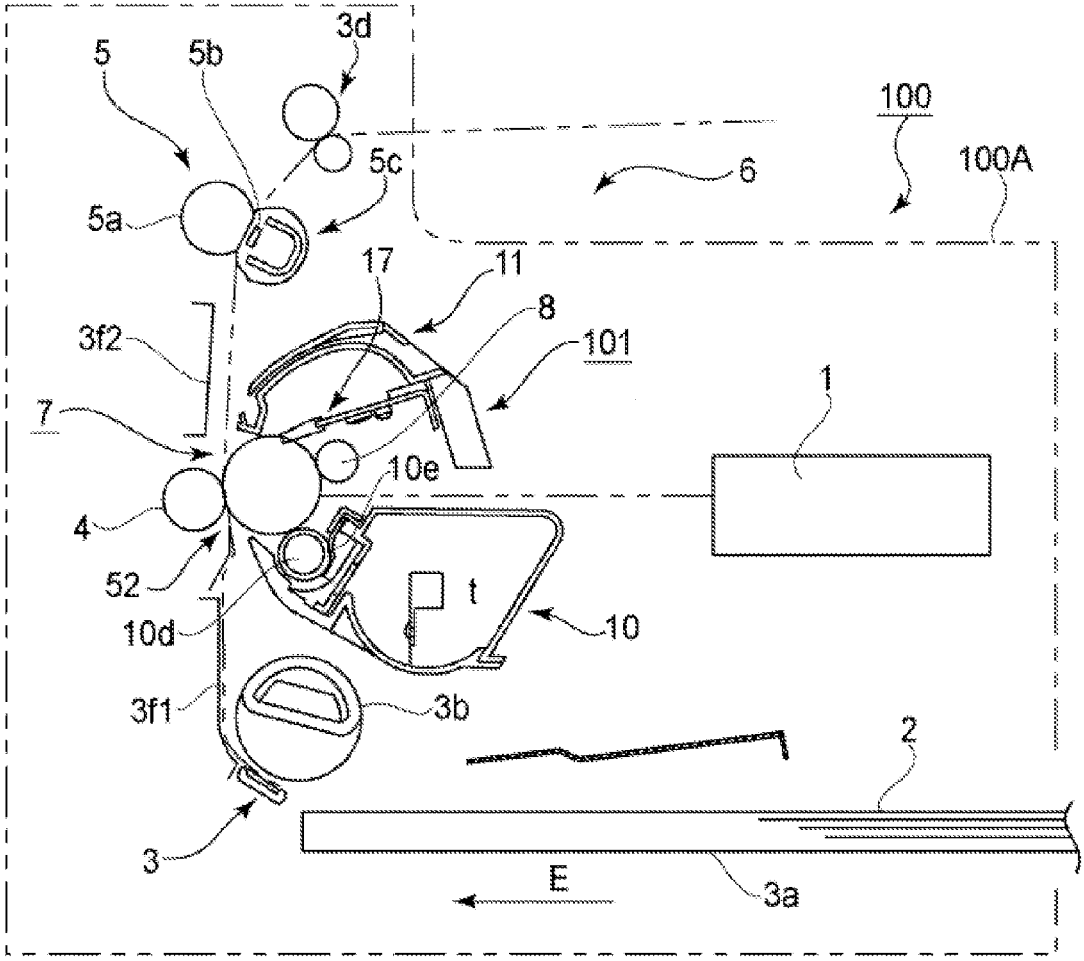
FIG. 1 is a schematic sectional view of a typical image forming apparatus to which the present invention is applicable. It shows the general structure of the apparatus.

FIG. 1 is a sectional view of the image forming apparatus 100 in the first preferred embodiment of the present invention. It shows the general structure of the apparatus 100. The image forming apparatus 100 is an image forming apparatus which uses an electrophotographic image formation process. As is evident from FIG. 1, the image forming apparatus 100 has the main assembly 100A (which hereafter will be referred to as apparatus main assembly 100A). The apparatus main assembly 100A has an image formation station 52 where an image is formed. The image formation station 52 comprises an electrophotographic photosensitive drum 7 (which hereafter will be referred to simply as "photosensitive drum") as an image bearing member, and a transfer roller 4 as an image transferring member, etc.

The image forming operation performed by the image forming apparatus 100 is as follows: First, the photosensitive drum 7, which is in the form of a drum and has a photosensitive layer, is charged by a charge roller 8 across its peripheral surface. Then, the charged portion of the peripheral surface of the photosensitive drum 7 is exposed to (scanned by) a beam of laser light projected from an optical system 1 while being modulated according to the information of the image to be formed. Thus, an electrostatic latent image, which reflects the information of the image to be formed, is formed on the peripheral surface of the photosensitive drum 7. This electrostatic latent image is developed into a visible image formed of toner. More specifically, voltage is applied to a development roller 10*d*, as a developer bearing member, on which developer t is present. Consequently, the developer t transfers from the development roller 10*d* onto the photosensitive drum 7 in the pattern of the electrostatic latent image on the peripheral surface 7.

While the visible image is formed of the developer t on the peripheral surface of the photosensitive drum 7, a sheet 2 of recording medium (ordinary paper, OHP sheet, and the like) is conveyed by a conveying system 3 to the image formation station 52 from a cassette 3*a* in the direction indicated by an arrow mark E by a recording medium conveying device 3*b* (recording medium conveying means), while being guided by the first guiding plate 3*f*1, in synchronism with the formation of the visible image of the developer t. Then, the image formed on the peripheral surface of the photosensitive drum 7 of the developer t is transferred on to the sheet 2 of recording medium in the image formation station 52 by the application of voltage to the transfer roller 4 as the image transferring means. The image formation station 52 is in a cartridge 101, which is a process cartridge.

After the transfer of the image formed of the developer t (which hereafter may be referred to as developer image) onto the sheet 2 of recording medium, the sheet 2 is conveyed to the fixing device 5 as a fixing means while being guided by the second guiding plate 3*f*2. The fixing device 5 has a driver roller 5*a*, a fixation roller 5*c*, and a heater 5*b* which is in the hollow of the fixation roller 5*c*. After being conveyed through the fixing device 5, the sheet 2 is conveyed further by a pair of discharge rollers 3*d*, and is discharged into the delivery tray 6 through the sheet turning path. Incidentally, the image forming apparatus 100 is provided with an unshown combination of a manual feed tray and a manual feed roller, making it possible for a user to manually feed the sheet 2 of recording medium into the apparatus main assembly 100A.

Figure 2:
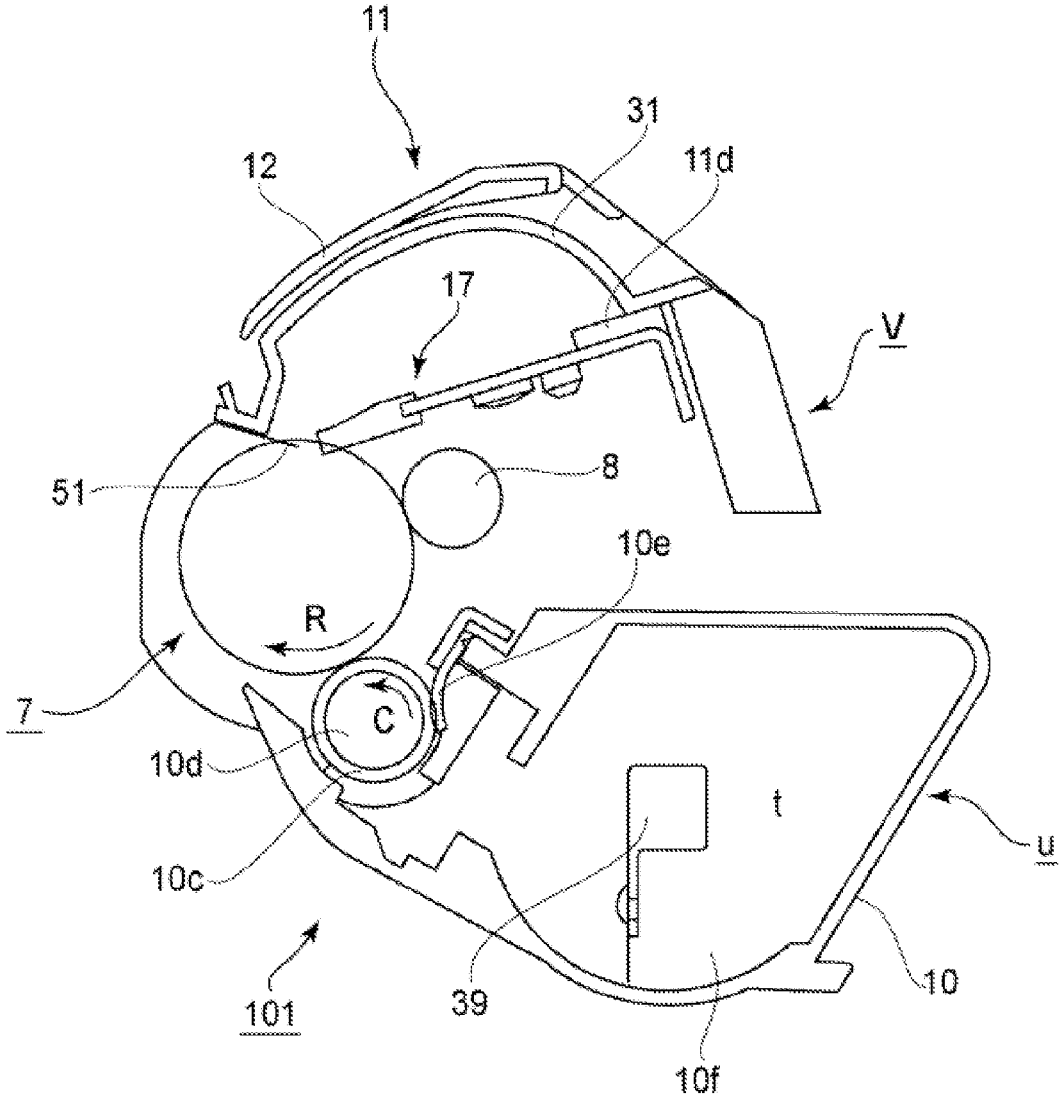
FIG. 2 is a schematic sectional view of the process cartridge in accordance with the present invention. It shows the structure of the cartridge.

FIG. 2 is a sectional view of the cartridge 101. It shows the structure of the cartridge 101. As is evident from FIG. 2, the cartridge 101 has the photosensitive drum 7, and a cleaning blade 17 for removing the developer remaining on the peripheral surface of the photosensitive drum 7, that is, one of the processing means.

In an image forming operation in which the cartridge 101 is used, the photosensitive drum 7 rotates in the direction indicated by an arrow mark R. As the photosensitive drum 7 rotates, its peripheral surface is uniformly charged by the charge roller 8 as a charging means. Then, the uniformly charged portion of the peripheral surface of the photosensitive drum 7 is exposed to (scanned by) a beam of the light projected from an optical system 1, through the opening with which the cleaning means frame 11 is provided. As a result, an electrostatic latent image is formed on the peripheral surface of the photosensitive drum 7. Incidentally, the photosensitive drum 7 is supported by the cleaning means frame 11.

The developing device 10 is provided with a development roller 10*d*, which is rotatably supported by the frame of the developing device 10. The developing device 10 is also provided with a development blade 10*e*, which is a developer regulating means. The development blade 10*e* is attached to the frame of the developing device 10 in such a manner that its tip portion is kept virtually in contact with the peripheral surface of the development roller 10*d*. Further, the developing device 10 is provided with a developer storage 10*f* in which the developer t is stored to be delivered to the development roller 10*d*.

As the development roller 10*d* is rotated, the developer t in the developer storage is borne by the peripheral surface 10*c* of the development roller 10*d*, and is regulated by the development blade 10*e*, whereby a layer of the developer t, which is uniform in thickness, is formed on the peripheral surface of the development roller 10*d*. Then, development bias is applied to the development roller 10*d*, whereby the developer t on the photosensitive drum 7 is transferred onto the peripheral surface of the photosensitive drum 7 in the pattern of the electrostatic latent image; the electrostatic latent image is developed into a visible image formed of the developer t. Then, the image formed of the developer t, that is, the visible image, is transferred onto the sheet 2 of recording medium by the application of transfer bias to the transfer roller 4 (FIG. 1).

After the transfer of the developer image onto the sheet 2, the developer t remaining on the peripheral surface of the photosensitive drum 7 is removed by the cleaning blade 17 as a cleaning means. The removed developer is collected in the cleaning means container 31. The cleaning means is provided with a sheet 51, which captures the residual developer as the residual toner is separated from the peripheral surface of the photosensitive drum 7 by the cleaning blade 17. The sheet 51 is on the upstream side of the cleaning blade 17 in terms of the rotational direction of the photosensitive drum 7. It is attached to the cleaning means frame 31. Further, the cleaning means is provided with a seal 11*d*, which is between the cleaning means container 31 and cleaning blade 17, and prevents the residual developer from leaking from the cleaning means container 31 after being removed by the cleaning blade 17 and collected in the cleaning means container 31.

Further, the cleaning device 11 has a protective shutter 12 for protecting the photosensitive drum 7. When the cartridge 101 is not in use, this protective shutter 12 remains in its protective position (unshown) in which it keeps the photosensitive drum 7 covered. As the cartridge 101 is mounted into the apparatus main assembly 100A, the protective shutter 12 is moved into its exposure position in which it keeps the photosensitive drum 7 exposed from the cartridge 101. That is, when the cartridge 101 is in use, the protective shutter 12 is in the exposure position. Thus, the cartridge 101 is structured so that the protective shutter 12 can be rotationally moved between the protective position and exposure position.

Figure 3:
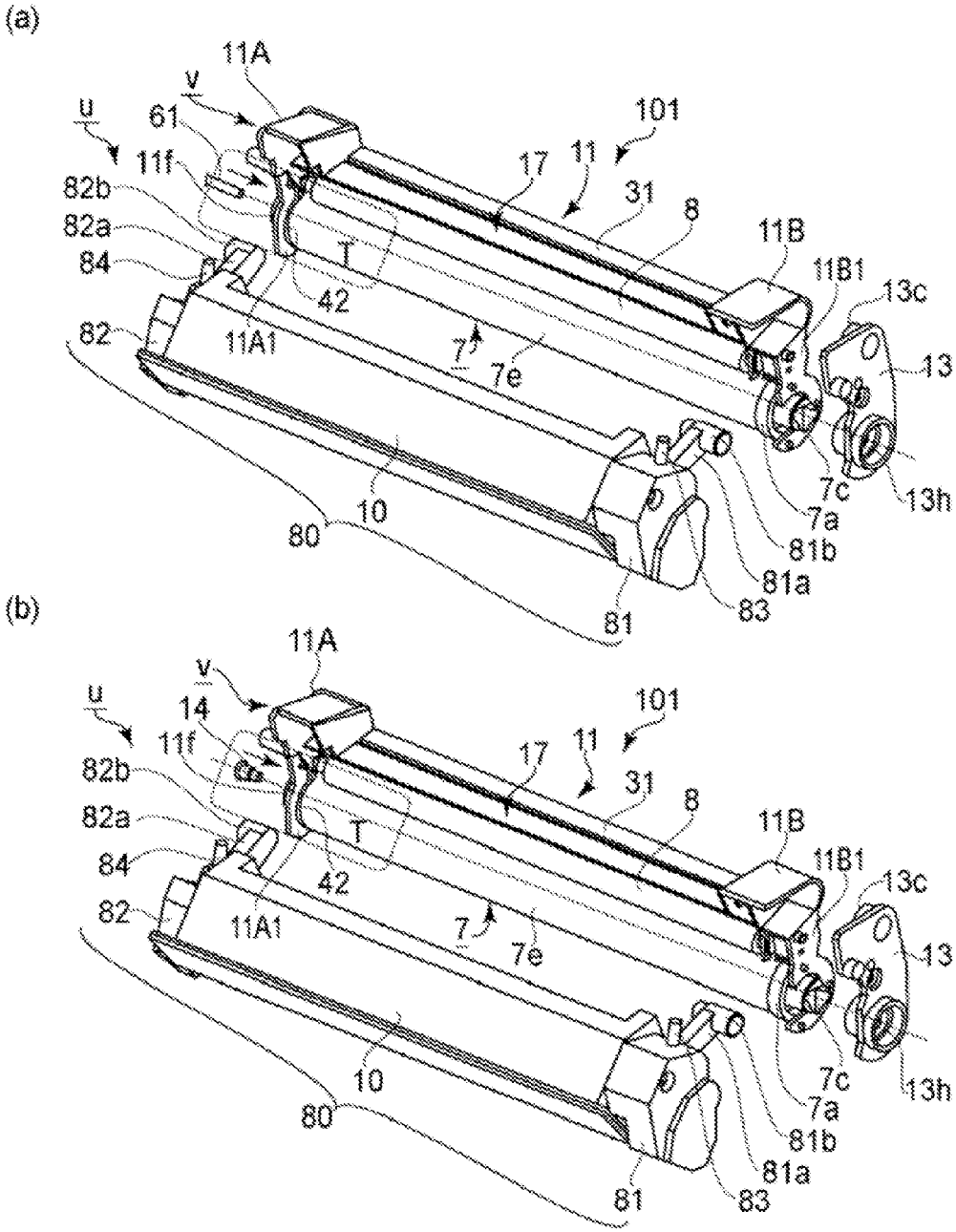
FIG. 3 is an exploded perspective view of the process cartridge in accordance with the present invention. It shows the structure of the cartridge.

FIG. 3(*a*) is an exploded perspective view of the development unit and cleaning unit. It shows the structure of the cartridge 101 and drum shaft 61. FIG. 3(*b*) also is an exploded perspective view of the development unit and drum unit. It shows the structure of the cartridge 101 and external electrical connector 14. As is evident from FIGS. 3(*a*) and 3(*b*), the cartridge 101 has the cleaning unit v as the first unit, and development unit u as the second unit, and drum holder 13. The cleaning unit v has the cleaning means container 31, photosensitive drum 7, charge roller 8 and cleaning blade 17.

The development unit u has the frame 80 and development roller 10*d* (FIG. 2). The frame 80 has the developer device 10 and a pair of end members 82 and 81. The end members 82 and 81 are solidly attached to the lengthwise ends of the developer device 10, one for one. The end member 82 rotationally supports the development roller 10*d* (FIG. 2) in the developing device 10, by one of the lengthwise ends of the development roller 10*d*. The end member 81 rotationally supports the development roller 10*d* (FIG. 2) in the developing device 10, by the other lengthwise end of the development roller 10*d*. The drum holder 13 is solidly attached to the cleaning device 11. It rotationally holds the photosensitive drum 7 and charge roller 8.

Next, the structural arrangement for supporting the development unit u by the cleaning unit v is described. As described before, the development unit u has the end members 82 and 81, which are attached to the lengthwise ends of the developing device 10, one for one. The end member 82 has an arm 82*a*, whereas the end member 81 has an arm 81*a*. The arms 82*a* and 81*a* point toward the cleaning unit v (and are perpendicular to the lengthwise direction of developing device 10). Further, the end members 82 and 81 are provided with a pair of shafts 82*b* and 81*b*, by which the development unit u is in connection to the cleaning unit v. The shafts 82*b* and 81*b* are attached to the tip of the arm 82*a*, and the tip of the arm 81*a*, respectively. The shaft 82*b* and 81*b* in each of the preferred embodiments of the present invention are cylindrical.

The photosensitive drum 7 has a cylindrical member 7*e* and an electrophotographic photosensitive layer. The cylindrical member 7*e* is made of an electrically conductive substance. The photosensitive layer covers the entirety of the peripheral surface of the cylindrical member 7*e*. The photosensitive drum 7 is provided with a drum gear 7*a* and a drum flange 42, which are solidly attached to the lengthwise ends of the cylindrical member 7*e*, one for one, by having been pressed into the opening of the lengthwise ends of the cylindrical member 7*e*. The lengthwise end of the photosensitive drum 7, which has the flange 42, is structured to allow the residual charge of the photosensitive drum 7 to escape to the apparatus main assembly 100A. The lengthwise end of the photosensitive drum 7, which has the drum gear 7*a*, is provided with a driving force transmitting portion 7*c* (coupling) into which the force for driving the photosensitive drum 7 is inputted from the driving force outputting portion (unshown) of the apparatus main assembly 100A.

Further, the lengthwise ends of the cleaning device 11 are provided with drum supporting portions 11A and 11B, one for one. The lengthwise end of the photosensitive drum 7, which has the drum flange 7*a*, is rotationally supported by a drum shaft 61 (FIG. 3(*a*)) or external electrical connector 14 (FIG. 3(*b*)), which is supported by the plate 11A1 of the drum supporting portion 11A. The drum shaft 61 and external electrical connector 14 are solidly attached to the first guiding portion 11*f* of the drum supporting plate 11A by having been pressed into the hole (unshown) of the guiding portion 11*f*. The other lengthwise end of the photosensitive drum 7 is rotationally supported by the drum supporting portion 13*h* of the drum holder 13 attached to the supporting plate 11B1 of the drum supporting portion 11B. That is, the cleaning device 11 rotatably holds one of the lengthwise ends of the photosensitive drum 7 by the drum supporting portion 11A, and the other lengthwise end of the photosensitive drum 7 by the drum holder 13.

Further, the plate 11A1 of the drum supporting portion 11A of the cleaning device 11 has a hole 11*e*, and the drum holder 13 has a hole 13*c*. The aforementioned shaft 82*b* and 81*b* are in the holes 11*e* and 13*c*, respectively, being thereby rotatably supported by the plate 11A1 of the drum supporting portion 11A and the drum holder 13, respectively. In other words, the development unit u is supported by the cleaning means container 31 and drum holder 13 in such a manner that the development unit u is rotationally moved relative to the cleaning unit v. As for the positional relationship between the development unit u and cleaning unit v in terms of the lengthwise direction of the cartridge 101, one of the lengthwise ends of the cleaning device 11 is provided with a regulating portion (unshown), and the drum holder 13 is provided with an arm catching portion (unshown), as a regulating portion. Thus, the movement of the arm 81*a* in the lengthwise direction of the cartridge 101 is regulated by the arm movement regulating portion of the drum cleaning device 11 and the arm catching portion of the drum holder 13, whereby the movement of the development unit u relative to the cleaning unit v in terms of the lengthwise direction of the cartridge 101 is regulated.

Figure 4:
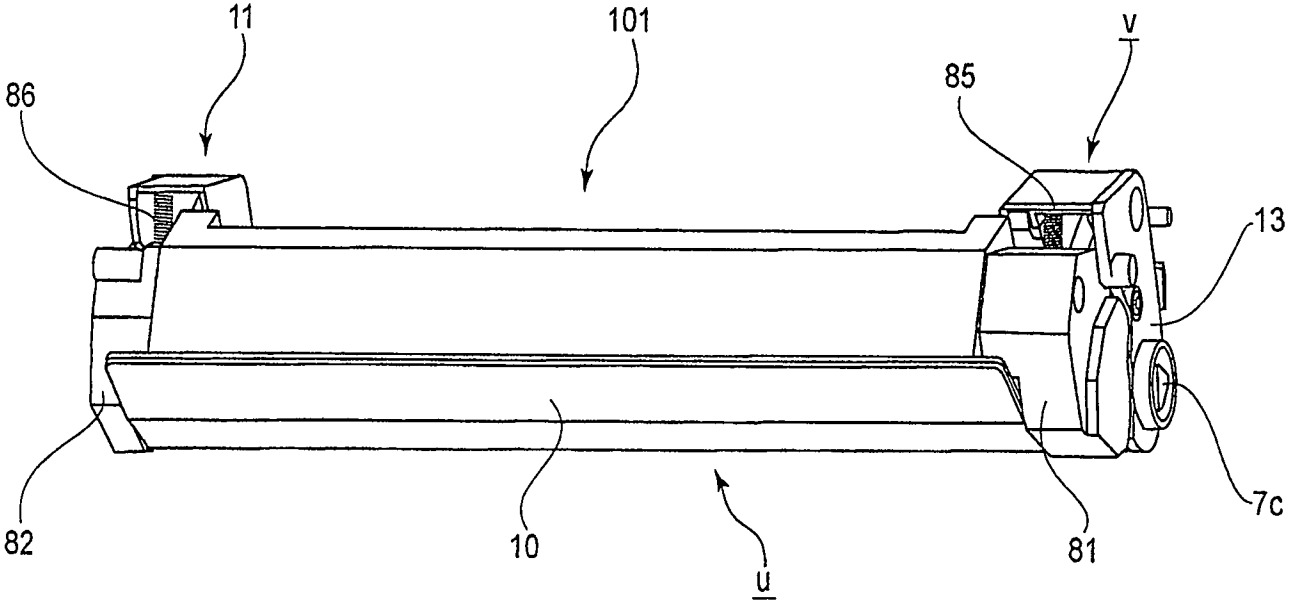
FIG. 4 is a perspective view of the process cartridge in accordance with the present invention. It shows the structure of the cartridge.

FIG. 4 is a perspective view of the cartridge 101. It shows the structure of the cartridge 101. As is evident from FIG. 4, the left end of the cartridge 101 has a compression spring 86, as a pressure applying member, which is fitted around the spring holder 84 (FIGS. 3(*a*) and 3(*b*)) of the end member 82. The right end of the cartridge 101 is provided with a compression spring 85, as a pressure applying member, which is fitted around the spring holder 83 (FIGS. 3(*a*) and 3(*b*)) of the end member 81. The compression springs 86 and 85 are kept compressed between the end members 82 and 81, and cleaning device 11, whereby the development unit u is kept pressed toward the photosensitive drum 7. Thus, the pair of gap maintaining members 10*c* (FIG. 2), with which the lengthwise ends of the development roller 10*d* are fitted one for one are kept in contact with the photosensitive drum 7. Therefore, the development roller 10*d* and photosensitive drum 7 face each other with the presence of a preset gap between the two. With the employment of the above described structural arrangement, the cleaning unit v and development unit u can be connected to each other, without using connector pins or the like, in such a manner that the two units u and v are rotationally movable relative to each other. Further, the drum holder 13, which is at the right end of the cartridge 101, supports both the photosensitive drum 7 and development unit u (more specifically, right shaft 81*b*). Therefore, the development roller 10*d* supported by the development unit u are precisely positioned relatively to the photosensitive drum 7.

Next, referring to FIG. 3(*a*), as described previously, the right end of the cartridge 101 has the drum gear 7*a* through which the force for driving the photosensitive drum 7 is transmitted to the photosensitive drum 7 from the apparatus main assembly 100A. It is also provided with the development roller gear (unshown) through which the force from the apparatus main assembly 100A is transmitted to the development roller 10*d*; the development roller gear is attached to the right end of the development roller 10*d*. Further, the right end of the cartridge 101 is provided with an idler gear (unshown) through which the driving force from the development roller gear is transmitted to the gear (unshown) connected to the developer conveyance member 39 (FIG. 2). The development roller gear, developer conveyance member gear, and idler gear, which make up a gear train, are covered with the right end member 81.

Embodiment 1

Figure 5:
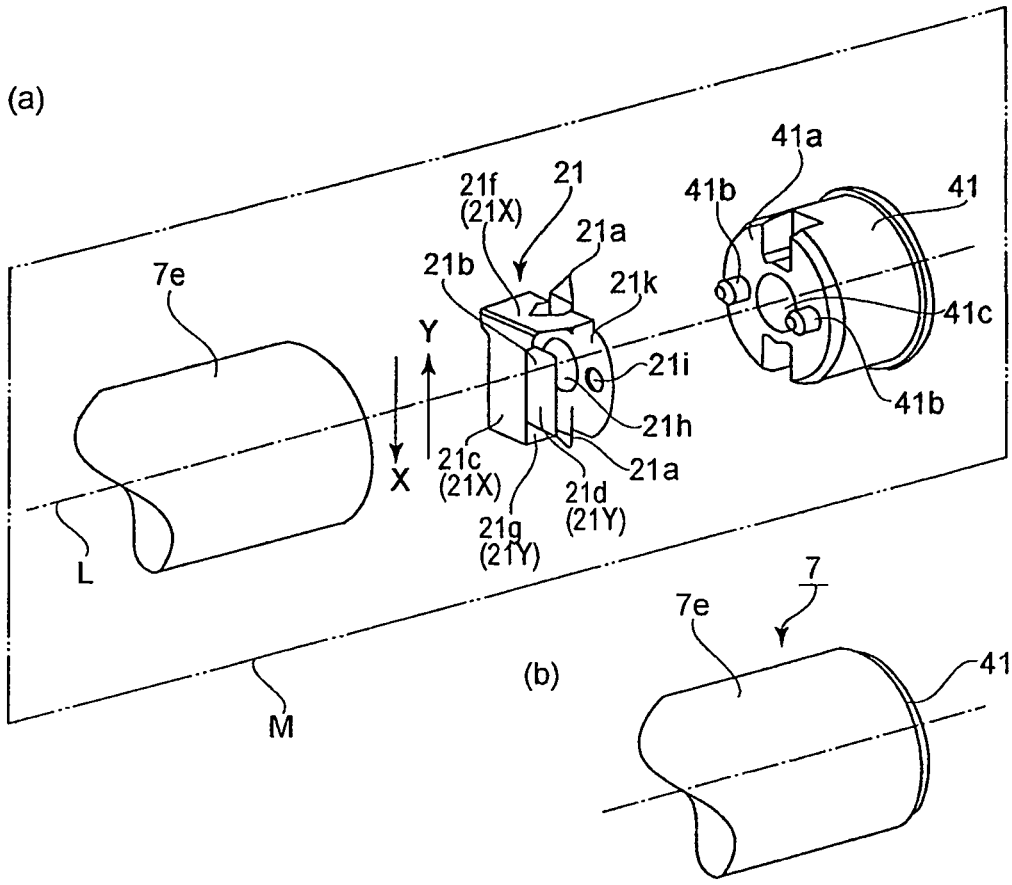
FIG. 5 is an exploded perspective view of one of the lengthwise end portions of the photosensitive drum, which has the electrical connector in the first preferred embodiment of the present invention. It shows the structure of the end portion.

FIG. 5(*a*) is an exploded perspective view of the right end portion of the photosensitive drum 7, that is, the end portion having the electrical connector 21, in the first preferred embodiment of the present invention. It shows the structure of the right end portion of the photosensitive drum 7. As is evident from FIG. 5(*a*), the photosensitive drum 7 comprises the cylindrical member 7*e*, an electrical connector 21, and a flange 41. The cylindrical member 7*e* is electrically conductive. Its peripheral surface is covered with a photoconductive layer. The flange 41 is for immovably supporting the electrical connector 21 within the cylindrical member 7*e*.

The electrical connector 21 is for keeping electrical connection between the cylindrical member 7*e* and the apparatus main assembly 100A. It has a pair of first portions of contact 21*a* and a second portion of contact 21*b*. The first portion of contact 21*a* is the portion of the electrical connector 21, by which the connector 21 contacts the inward surface of the cylindrical member 7*e*. The second portion of contact 21*b* is the portion of the electrical connector 21, by which the connector 21 contacts the drum shaft 61, as an "external electrical connector", which is has electrical connection to the outside of the cylindrical member 7*e*. The electrical connector 21 is made of metallic plate. It is structured as described above so that it maintains electrical connection with the outside. Hereafter, a hypothetical line which coincides with the axial line of the cylindrical member 7*e* is referred to as an axial line L, and a hypothetical vertical plane which includes the axial line L is referred to as a hypothetical plane M. Next, the structure of the electrical connector 21 is described in more detail with reference to the axial line L and hypothetical plane M. The axial line L and hypothetical plane M are shown only in FIG. 5(*a*); they are not shown in FIGS. 5-15. However, all the electrical connectors shown in FIGS. 5-15 also are described with reference to the axial line L and hypothetical plane M.

The electrical connector 21 has a base section 21*k*, a first section 21X, and a second section 21Y. The first section 21X extends from the base section 21*k* and is flexible (first flexible section). The second section 21Y extends from the first section 21X, and is flexible (second flexible section). That is, each of the first and second sections 21X and 21Y is a part of the electric current path between the first and second portions of contact 21*a* and 21*b*, and is flexible.

The first section 21X has a first horizontal portion 21*f* and a first vertical portion 21*c*. The first horizontal portion 21*f* extends from the base section 21*k*, and the first vertical portion 21*c* extends from the first horizontal portion 21*f*. The first horizontal portion 21*f* is parallel to the axial line L, that is, the direction parallel to the lengthwise direction of the cylindrical member 7*e*. It extends across the axial line L. The first vertical portion 21*c* is perpendicular to the axial line L, and parallel to the first diameter direction X of the hypothetical plane M. To describe the first diameter direction X in more detail with reference to FIG. 5, not only does it mean the straight downward direction of the electrical connector 21 when the electrical connector 21 is in its properly position in the cylindrical member 7*e*, but also, such a downward direction as the direction of the curvature of the electrical connector 21, shown in FIG. 9, when the electrical connector 21 is in the proper position in the cylindrical member 7*e*. Further, it is not mandatory that the first diameter direction X is on the hypothetical plane M; the first diameter direction X may be on another plane which is parallel to the hypothetical plane M.

The second section 21Y has a second horizontal portion 21*g* and a second vertical portion 21*d*. The portion 21*g* extends toward the flange 41 from the first vertical portion 21*c* of the first section 21X. It is parallel to the axial line L. The second vertical portion 21*d* extends from the second horizontal portion 21*g* of the second section 21Y in the second diameter direction Y of the hypothetical plane M, which is opposite from the first diameter direction X, beyond the axial line L. To describe the second diameter direction Y in more detail with reference to FIG. 5, not only does it mean the straight upward direction of the electrical connector 21 when the electrical connector 21 is in its proper position in the cylindrical member 7*e*, but also, such an upward direction as the direction of the curvature of the electrical connector 21, which is unshown, when the electrical connector 21 is in its proper position in cylindrical member 7*e*. Further, it is not mandatory that the second diameter direction Y is on the hypothetical plane M; the second diameter direction Y may be on another plane which is parallel to the hypothetical plane M.

The first and second portions of contact 21*a* and 21*b*, and the first and second sections 21X and 21Y between the two portions of contact 21*a* and 21*b*, are integral parts of the electrical connector 21. The first and second portions of contact 21*a* and 21*b* are electrically in connection to each other by way of the first and second sections 21X and 21Y. Further, the first and second sections 21X and 21Y are physically in connection to each other, and the second portion of contact 21*b* is physically in contact with the second section 21Y (structurally connected). Further, the electrical connector 21 is structured so that as the drum shaft 61 comes into contact with the second portion of contact 21*b*, the second portion of contact 21*b* displaces in the direction parallel to the axial line L.

The electrical connector 21 is structured so that when it is in its proper position in the cylindrical member 7*e*, the second portion of contact 21*b* intersects with the hypothetical plane M. However, it is not mandatory that when the electrical connector 21 is in its proper position in the cylindrical member 7*e*, the second portion of contact 21*b* intersects with the hypothetical plane M; the second portion of contact 21*b* may be offset from the hypothetical plane M. Further, the electrical connector 21 is structured so that when it is in its proper position in the cylindrical member 7*e*, the second portion of contact 21*b* is on the axial line L, which coincides with the axial line of the cylindrical member 7*e*. However, it is not mandatory that when the electrical connector 21 is in its proper position in the cylindrical member 7*e*, the second portion of contact 21*b* is on the axial line L.

The electrical connector 21 has the base section 21*k*. The base section 21*k* has multiple (two in this embodiment) holes for immovably attaching the electrical connector 21 to the flange 41. It has also a hole 21*h*, through which the drum shaft 61 (FIG. 6(*c*)) or 64 (FIG. 6(*d*)) is put. The hole 21*h* is greater in diameter than the drum shaft 61, and the hole 41*c* of the flange 41. The hole 41*c* will be described later.

The flange 41 has an electrical connector seat 41*a*, which accommodates the base section 21*k* of the electrical connector 21. The electrical connector seat 41*a* has multiple (two in this embodiment) pins 41*b* for properly positioning the electrical connector 21 relative to the flange 41. It has also a through hole 41*c*, which extends from the outward side of the flange 41 to the inward side, and through which the drum shaft 61 or external electrical connector 14 is put. The through hole 41*c* is slightly greater in diameter than the drum shaft 61 or external electrical connector 14. The direction of the through hole 41*c* is such that after the electrical connector 21 is properly attached to the flange 41, the axial line of the flange 41 coincides with the axial line L.

FIG. 5(*b*) is a perspective view of the photosensitive drum 7. It shows the structure of the photosensitive drum 7. The procedure for attaching the electrical connector 21 to the photosensitive drum 7 is as follows: First, the electrical connector 21 is attached to the flange 41. Then, the combination of the electrical connector 21 and flange 41 is attached to the cylindrical member 7*e*, yielding thereby the photosensitive drum 7 shown in FIG. 5(*b*).

Figure 6:
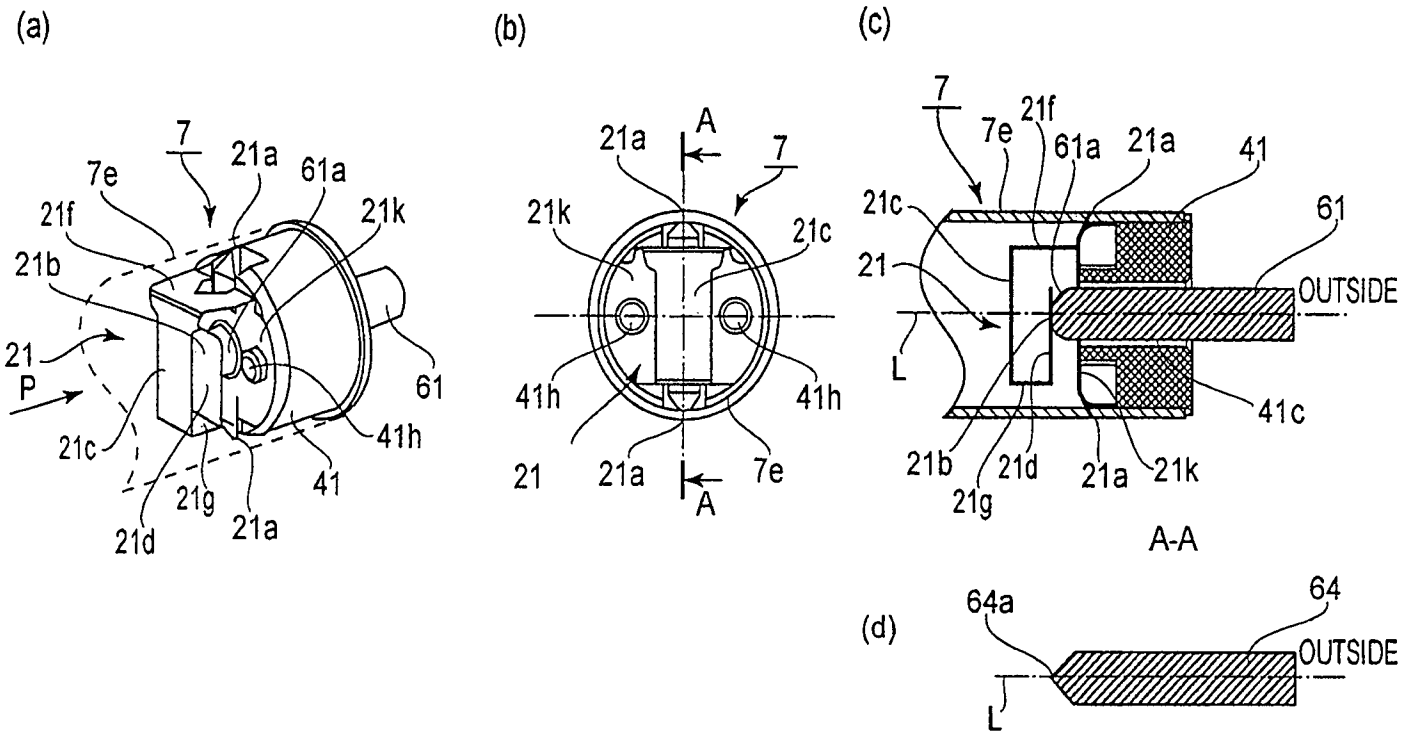
FIG. 6 is a drawing for describing the structure of one of the lengthwise end portions of the photosensitive drum in the first embodiment, FIGS. 6(*a*), 6(*b*), 6(*c*) and 6(*d*) being: a perspective view of the combination of the electrical connector, cylindrical member, and drum; a plan view of the combination of the electrical connector, cylindrical member, and flange; a sectional view of the combination of the electrical connector, cylindrical member, flange, and drum shaft, at a vertical plane which coincides with the axial line of the drum shaft; and a sectional view of the drum shaft, at a plane which coincides with the axial line of the drum shaft, respectively.

FIG. 6(*a*) is a perspective view of the combination of the electrical connector 21, drum shaft 61, and flange 41. It shows the structural arrangement of the combination. FIG. 6(*b*) is a plan view of the combination of the electrical connector 21, drum shaft 61, and flange 41. It shows the structural arrangement of the combination. The two positioning pins 41*b* (FIG. 5(*a*)) of the flange 41 are put through the two positioning holes 21*i* (FIG. 5(*a*)) of the electrical connector 21, whereby the electrical connector 21 and flange 41 are accurately positioned relative to each other. Then, the electrical connector 21 is fastened to the flange 41 by deforming (flattening) the tip of each positioning pin 41*b*, which protrudes from the base section 21*k*, by applying pressure to the tip while thermally softening the tip, as shown in FIGS. 6(*a*) and 6(*b*), which show the thermally flattened portions 41*h* of the multiple (two in this embodiment) positioning pins 41*b*.

Then, the combination of the electrical connector 21 and flange 41 is fastened to the cylindrical member 7*e*, whereby the electrical connector 21 is placed in the cylindrical member 7*e*, being thereby accurately positioned relative to the photosensitive drum 7. The presence of the flange 41 makes it possible for an assembly worker to attach the electrical connector 21 to the cylindrical member 7*e* without touching the electrical connector 21. Thus, it can prevent the electrical connector 21 from being accidentally deformed when it is attached to the cylindrical member 7*e*.

FIG. 6(*c*) is a sectional view of the right end portion of the photosensitive drum 7. It shows the structure of the right end portion. It corresponds to the area of FIG. 6(*a*) surrounded by a broken line. As is evident from FIG. 6(*c*), the first portion of contact 21*a* is in contact with the inward surface of the cylindrical member 7*e*. Inside the cartridge 101, or apparatus main assembly 100A, the inward portion of contact 61*a* of the drum shaft 61, which is semispherical, is in contact with the second portion of contact 21*b* of the electrical connector 21. Thus, as the positional relationship between the cylindrical member 7*e* and drum shaft 61 changes in such a manner that the inward portion of contact 61*a* of the drum shaft 61 is moved inward of the photosensitive drum 7 from the initial portion of contact between the inward portion of contact 61*a* and second portion of contact 21*b*, the second portion of contact 21*b* is displaced in the direction parallel to the axial line L, in the cylindrical member 7*e*. As the second portion of contact 21*b* is displaced, the first and second vertical portions 21*c* and 21*d*, which are springy, are resiliently bent, whereby the second portion of contact 21*b* is kept in contact with the inward portion of contact 61*a* of the drum shaft 61 with the presence of a preset amount of contact pressure between the two. Thus, it is ensured that the cylindrical member 7*e* maintains electrical connection with the apparatus main assembly 100A.

The drum shaft 61 in this embodiment is made of a metallic substance. However, this embodiment is not intended to limit the present invention in scope. That is, the drum shaft 61 may be replaced with any shaft which is the same in size as the shaft 61 and is made of an electrically conductive substance. For example, the drum shaft 61 may be made of metallic plate. Further, the drum shaft 61 may be replaced with a drum shaft 64 (FIG. 6(*d*)), the inward tip 64*a*, as the internal point of contact of the external electrical connector, which is pointed.

In a case where a large number of the electrical connectors 21 are formed of a springy substance, each electrical connector 21 is different from the other electrical connector 21 in the manner in which it resiliently bends, because of the manufacture errors. Therefore, it is not with a specific point of the second portion of contact 21*b* of the electrical connector 21 that the inward end of the drum shaft 61 remains in contact.

That is, the point of contact between the second portion of contact 21*b* and the inward end of the drum shaft 61 shifts within a certain range, which is not very wide. Thus, in order to ensure that as long as the inward end of the drum shaft 61 remains in contact with this limited area of the second portion of contact 21*b* of the electrical connector 21, the electrical connector 21 remains electrically connected to the drum shaft 61, the manufacturing operation has to controlled in terms of the state (texture, adherents, etc.) of the surface of the electrical connector 21, in particular, the second portion 21*b* of contact of the electrical connector 21.

FIG. 6(*d*) is a sectional view of the drum shaft 64, as an external electrical connector, with which the drum shaft 61 can be replaced. It shows the structure of the shaft 64. As is evident from FIG. 6(*d*), with the use of the drum shaft 64, the inward end of which is pointed, the area of the inward end portion of the drum shaft 64, with which the second portion of contact 21*b* of the second section 21Y of the electrical connector 21 comes into contact, is limited to a single point, that is, the inward end 64*a*. Thus, using the drum shaft 64 in place of the drum shaft 61 affords more latitude in the manufacturing of the cartridge 101.

Incidentally, as described previously, the hole 21*h* (FIG. 5(*a*)) of the electrical connector 21 is made greater in diameter than the hole 41*c* of the flange 41. Therefore, even if the drum shaft 61 becomes angled relative to the axial line L of the cylindrical member 7*e*, the drum shaft 61 is prevented from coming into contact with the base section 21*k* of the electrical connector 21.

As described above, according to this embodiment, in order to allow the residual charge of the photosensitive drum 7 to escape to the apparatus main assembly 100A, the electrical connector 21 is formed of an electrically conductive springy substance. Further, as the drum shaft 61 is inserted into the hole of the flange 41, not only does the second portion of contact 21*b* of the electrical connector 21 come into contact with the drum shaft 61, but also, it is displaced in the direction parallel to the axial line L of the cylindrical member 7*e*. Thus, it is ensured by the springiness of the electrical connector 21 that the second portion of contact 21*b* is kept in contact with the drum shaft 61 with the presence of a certain amount of contact pressure between the second portion of contact 21*b* and drum shaft 61.

Embodiment 2

Figure 7:
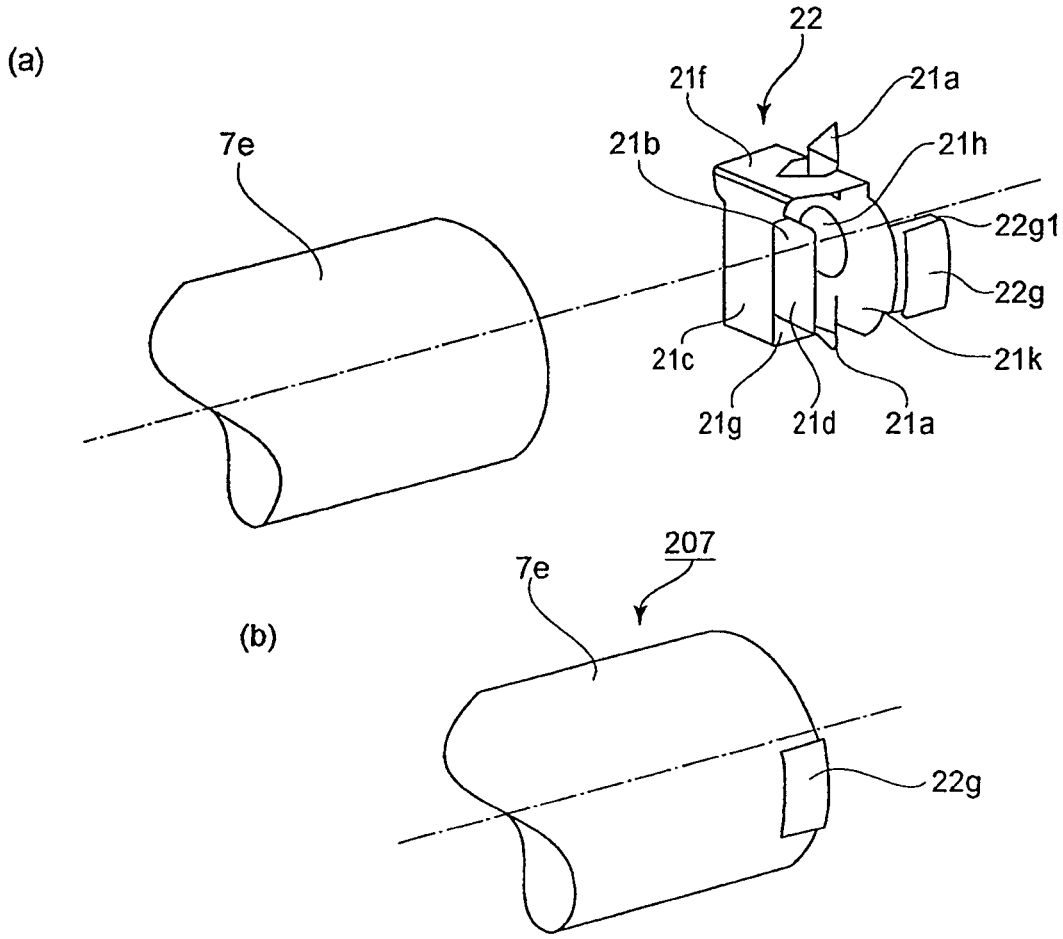
FIG. 7 is a drawing for describing the structure of one of the lengthwise end portions of the photosensitive drum in the second embodiment, FIGS. 7(*a*) and 7(*b*) being: an exploded perspective of the lengthwise end portions of the photosensitive drum, which has the electrical connector; and a perspective view of the combination of the cylindrical member and the fastener portion of the electrical connector, respectively.

FIG. 7(*a*) is an exploded perspective view of the right end portion of the photosensitive drum 207 in the second preferred embodiment of the present invention. It shows the structure of the right end portion of the photosensitive drum 207, which has an electrical connector 22. FIG. 7(*b*) is a perspective view of the right end portion of the photosensitive drum 207. It shows the structure of the right end portion. The structural components of the photosensitive drum 207 in the second embodiment, which are the same in structure and effects as the counterparts in the first embodiment, are given the same referential codes as those given to the counterparts one for one, and are not going to be described here. The cartridge and image forming apparatus to which the electrical connector 22 in the second embodiment is compatible are the same as the one in the first embodiment. Therefore, they are not going to be described here. The difference between the right end of the photosensitive drum in this embodiment and that in the first embodiment is as follows: The right end of the photosensitive drum in this embodiment has no flange 41. Instead, the electrical connector 22 in this embodiment is provided with a pair of anchoring portions 22*g*, with which the electrical connector 22 is fastened to the right end of the cylindrical member 7*e*.

Referring to FIG. 7(*a*), the electrical connector 22 has a pair of anchoring portions 22*g*, which are in the form of a clip and extend from the base section 21*k*. More specifically, the pair of anchoring portions 22*g* extend from the left and right ends of the base section 21*k*, one for one, in terms of the direction perpendicular to the first and second sections 21X and 21Y of the electrical connector 22. Each anchoring portion 22*g* extends a preset length from the base section 21*k* in the opposite direction from the second portion of contact 21*b*, and doubles back toward the second portion of contact 21*b*, providing thereby the anchoring portion 22*g* with a recess 22*g*1, in which the end portion of the cylindrical member 7*e* is fitted. In other words, the electrical connector 22 is placed and retained in the cylindrical member 7*e* by being directly fastened to the cylindrical member 7*e* by its anchoring portions 22*g*. That is, in this embodiment, the electrical connector 22 is held to the photosensitive drum 207 without the flange 41.

Figure 8:
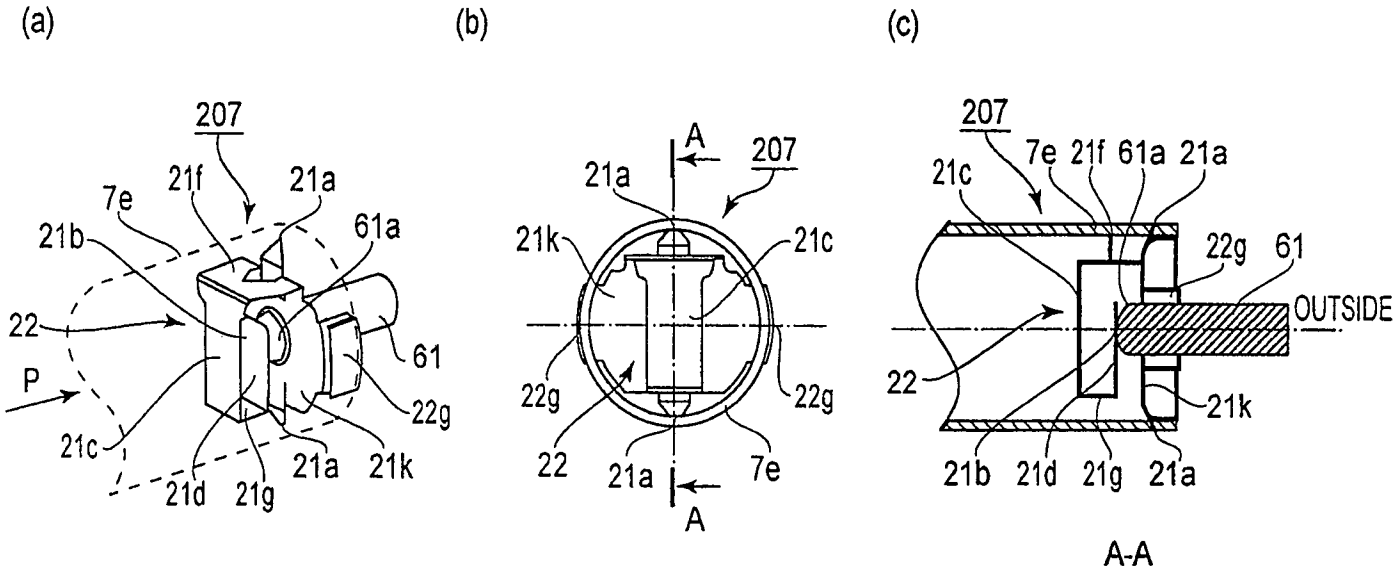
FIG. 8 is a drawing for describing the structure of one of the lengthwise end portions of the photosensitive drum in the second embodiment, FIGS. 8(*a*), 8(*b*) and 8(*c*) being: a perspective view of the combination of the electrical connector and drum; a plan view of the combination of the electrical connector and cylindrical member of the photosensitive drum; and a sectional view of the combination of the electrical connector, cylindrical member, and shaft of the photosensitive drum, at a vertical plane which coincides with the axial line of the shaft, respectively.

FIG. 8(*a*) is a perspective view of the combination of the electrical connector 22 and drum shaft 61. It shows the structure of the combination. FIG. 8(*b*) is a plan view of the combination of the cylindrical member 7*e* (right end portion) and electrical connector 22. It shows the structure of the combination. FIG. 8(*c*) is a sectional view of the cylindrical member 7*e* (right end portion), electrical connector 22, and drum shaft 61, at the aforementioned plane M. It shows the structure of the combination. As is evident from the drawings, a part of the anchoring portion 22*g* fits on the outward side of the cylindrical member 7*e*. Otherwise, the electrical connector 22 is the same in structure as the electrical connector 21 in the first embodiment. Therefore, the effects of the electrical connector 22 are the same as those of the electrical connector 21.

Embodiment 3

Figure 9:
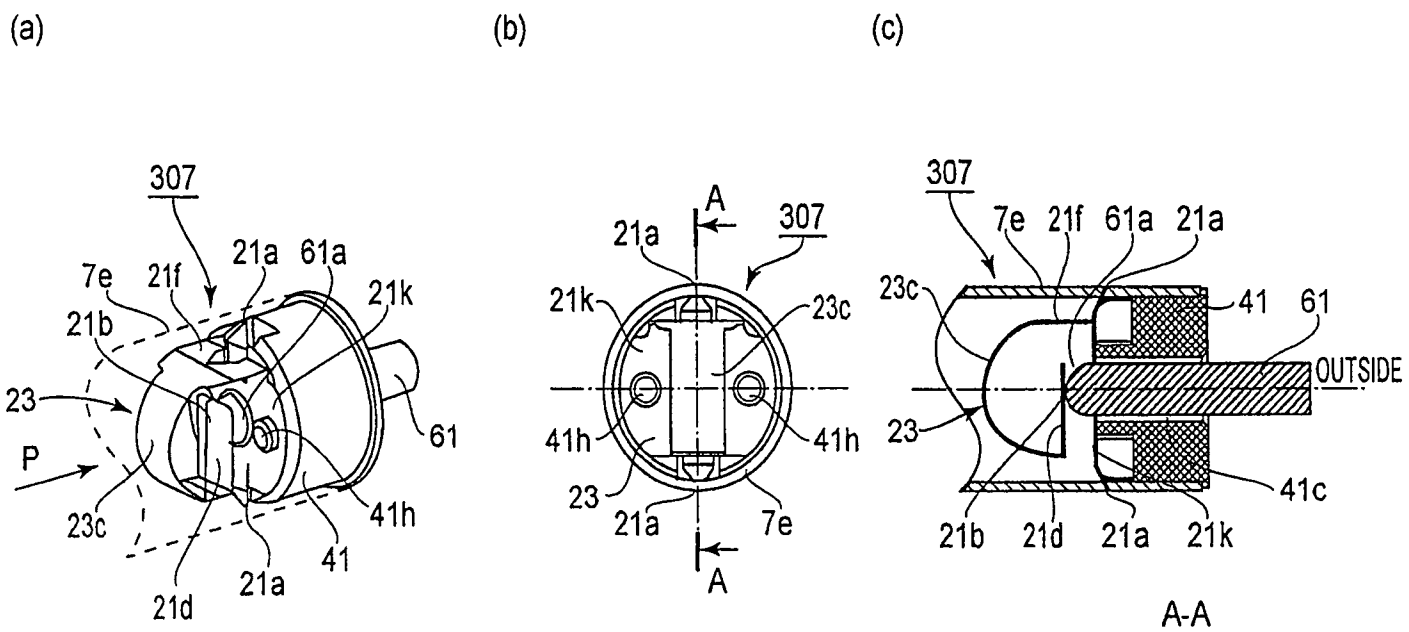
FIG. 9 is a drawing for describing the structure of one of the lengthwise end portions of the photosensitive drum in the third embodiment, FIGS. 9(*a*), 9(*b*) and 9(*c*) being: a perspective view of the combination of the electrical connector and drum shaft; a plan view of the combination of the electrical connector and cylindrical member of the photosensitive drum; and a sectional view of the combination of the electrical connector, cylindrical member, and drum shaft, at a vertical plane which coincides with the axial line of the shaft, respectively.

FIG. 9(*a*) is a perspective view of the combination of the electrical connector 23, drum shaft 61, and flange 41 in the third preferred embodiment. It shows the structure of the combination. FIG. 9(*b*) is a plan view of the combination of the cylindrical member 7*e* (right end portion), electrical connector 23, and flange 41. It shows the structure of the combination. FIG. 9(*c*) is a sectional view of the cylindrical member 7*e* (right end portion), electrical connector 23, flange 41, and drum shaft 61, at the aforementioned plane M. It shows the structure of the combination. The structural components of the photosensitive drum 307 in the third embodiment, which are the same in structure and effects as the counterparts in the first and second embodiments are given the same referential codes as those given to the counterparts one for one, and are not going to be described here. The cartridge and image forming apparatus to which the electrical connector 23 in the third embodiment is compatible are the same as those in the first embodiment. Therefore, they are not going to be described here. The electrical connector 23 in the third embodiment is different from the electrical connectors 21 and 22 in the first and second embodiments in that the electrical connector 23 does not have portions equivalent to the portions 21*c*, and 21*g*. Instead, it has a portion 23*c* which semicircularly extends from the portion 21*f*, and the second portion 21*d* extends from the portion 23*c*.

As is evident from FIGS. 9(*a*)-9(*c*), the electrical connector 23 has the portion 21*f*, which is a part of the "first flexible section" which extends from the base section 21*k*. That is, it is from the portion 21*f* that the semicircular portion 23*c*, which is a part of the first flexible portion 23*c*, extends. From the portion 21*f*, the second vertical portion 21*d*, which is a part of the "second flexible section", extends. As seen from the direction perpendicular to the hypothetical plane M of the cylindrical member 7*e*, the portion 23*c* appears semicircular, and extends beyond the axial line L.

Embodiment 4

Figure 10:
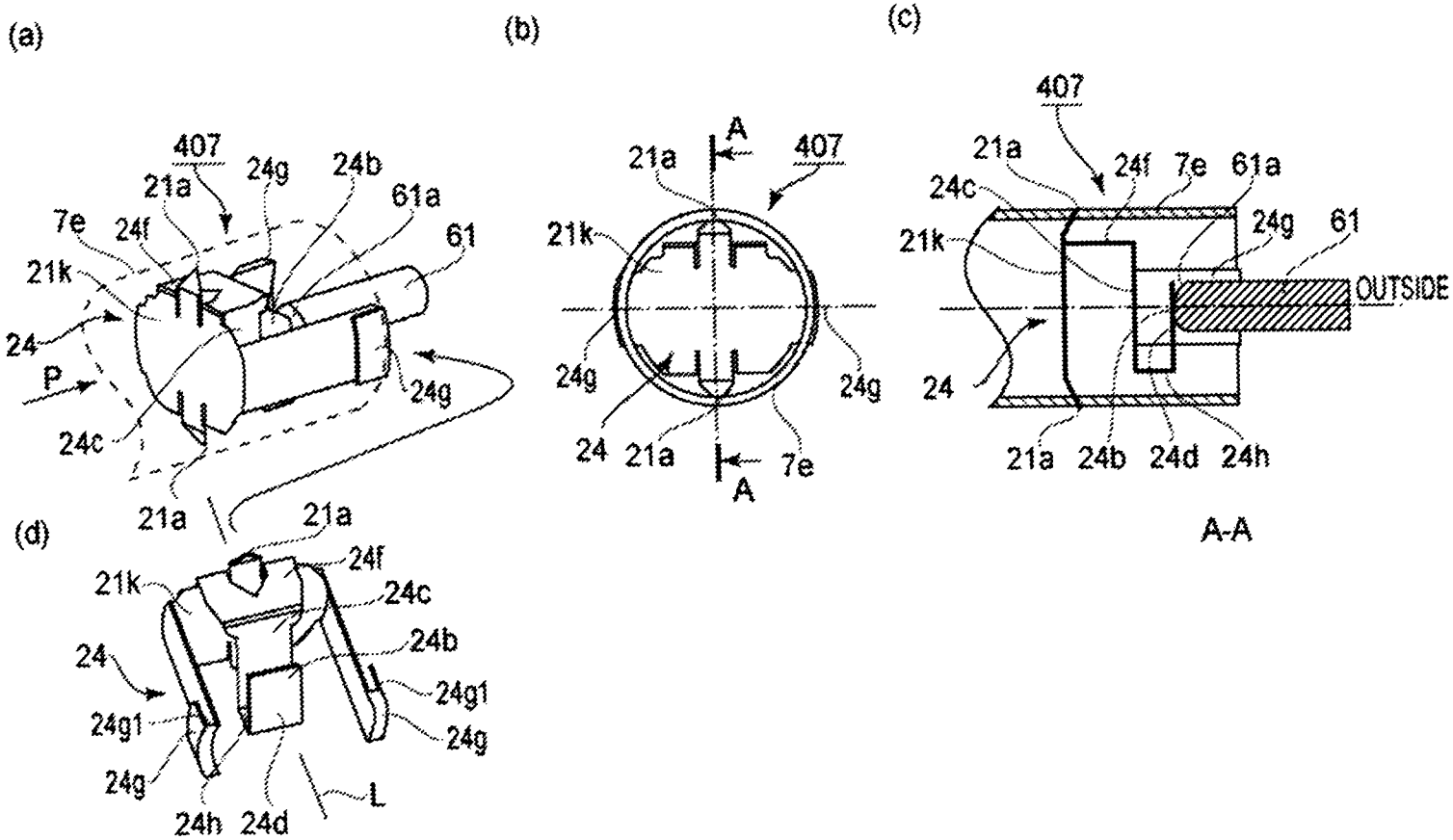
FIG. 10 is a drawing for describing the structure of one of the lengthwise end portions of the photosensitive drum in the fourth embodiment, FIGS. 10(*a*), 10(*b*), 10(*c*) and 10(*d*) being: a perspective view of the combination of the electrical connector and drum shaft; a plan view of the combination of the electrical connector and cylindrical member; a sectional view of the combination of the electrical connector, cylindrical member, and drum shaft, at a vertical plane which coincides with the axial line of the drum shaft, respectively.

FIG. 10(*a*) is a perspective view of the combination of the electrical connector 24 and drum shaft 61 in the fourth preferred embodiment of the present invention. It shows the structure of the combination. FIG. 10(*b*) is a plan view of the combination of the photosensitive drum 407 (right end portion) and electrical connector 24. It shows the structure of the combination. FIG. 10(*c*) is a sectional view of the electrical connector 24, cylindrical member 7*e* (right end portion), and drum shaft 61, at the aforementioned plane M. It shows the structure of the combination. The structural components of the photosensitive drum 407, cartridge, and image forming apparatus in the fourth embodiment, which are the same in structure and effects as the counterparts in the first to third embodiments are given the same referential codes, and are not going to be described here. The cartridge and image forming apparatus to which the electrical connector 24 in this embodiment is compatible are the same as those in the first embodiment. Therefore, they are not going to be described here. The electrical connector 24 in the fourth embodiment is different from the electrical connector 21-23 in the first to third embodiments in that the electrical connector 24 has portions 24*f*, 24*c*, 24*h*, 24*d*, and 21*k*, and the portions 24*f* and 24*h* extend in the opposite direction from the direction in which their counterparts in the preceding embodiments extend.

Referring to FIGS. 10(*a*)-10(*c*), the electrical connector 24 has the base section 21*k*, first horizontal portions 24*f*, first vertical portion 24*c*, second horizontal portion 24*h*, and second vertical portion 24*d*. The first horizontal portion 24*f* is a part of the "first flexible section" and extends from the base section 21*k* toward the drum shaft 61 in the direction parallel to the axial line L. The first vertical portion 24*c* is a part of the "first flexible section". It extends from the end of the portion 24*f* in the first diameter direction X, which is perpendicular to the axial line L. From the end of the portion 24*c*, the second horizontal portion 24*h*, which is a part of the "second flexible section", extends toward the drum shaft 61 in the direction parallel to the axial line L. From the end of the portion 24*h*, the second vertical portion 24*d*, which is a part of the "second flexible section", extends in the second diameter direction Y, which is perpendicular to the axial line L. The portions 24*f*, 24*c*, 24*h*, and 24*d* are parallel to the hypothetical plane M. Further, the vertical portions 24*c* and 24*d* extend across the axial line L.

FIG. 10(*d*) is a perspective view of the electrical connector 24. As is evident from FIG. 10(*d*), the electrical connector 24 has the base section 21*k*. The base section 21*k* has a pair of first portions of contact 21*a*, which extend from the top and bottom ends of the base section 21*k*. The aforementioned first horizontal portion 24*f* extends in the direction perpendicular to the axial line L from the point of the base section 21*k*, from which the top first portion of contact 21*a* extends. It is from the portion 24*f* that the portion 24*c* extends from the direction perpendicular to the axial line L. From the portion 24*c*, the portion 24*h* extends in the direction parallel to the axial line L. It is from the portion 24*h* that the portion 24*d* extends in the direction perpendicular to the axial line L. The portion 24*d* has the second portion of contact 24*b* as does the counterparts in the first and second embodiments. Further, the electrical connector 24 has a pair of anchoring portions 24*g* for fastening the electrical connector 24 to the end of the cylindrical member 7*e*. The anchoring portion 24*g* has a recess (gap) 24*g*1 in which the end of the cylindrical member 7*e* is fitted.

Embodiment 5

Figure 11:
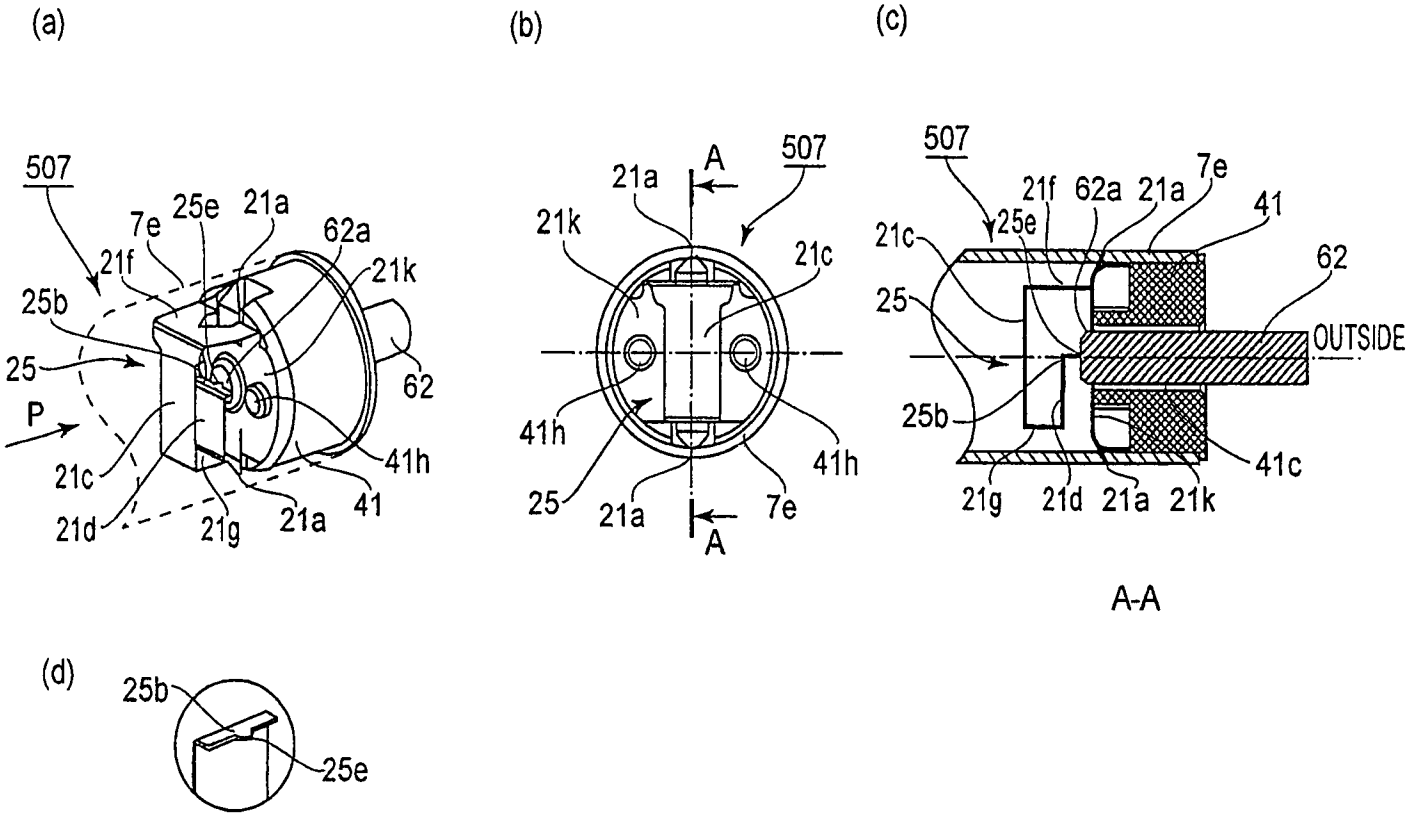
FIG. 11 is a drawing for showing the structure of one of the lengthwise end portions of the photosensitive drum in the fifth preferred embodiment of the present invention, FIGS. 11(*a*), 11(*b*), 11(*c*) and 11(*d*) being a perspective view the combination of the electrical connector, flange, and drum shaft; a sectional view of the combination of the electrical connector, cylindrical member, and flange, at a plane perpendicular to the axial line of the shaft; a sectional view of the combination of the electrical connector, cylindrical member, flange, and drum shaft, at a vertical plane which coincides with the axial line of the shaft; and a perspective view of the tip portion of the portion of contact of the electrical connector, respectively.

FIG. 11(*a*) is a perspective view of the combination of the electrical connector 25, drum shaft 62, and flange 41 in the fifth preferred embodiment of the present invention. It shows the structure of the combination. FIG. 11(*b*) is a plan view of the combination of the cylindrical member 7*e* (right end portion), electrical connector 25, and flange 41. It shows the structure of the combination. FIG. 11(*c*) is a sectional view of the cylindrical member 7*e* (right end portion), electrical connector 25, flange 41, and drum shaft 62, at the aforementioned plane M. It shows the structure of the combination. The structural components of the photosensitive drum 507, cartridge, and image forming apparatus in the fifth embodiment, which are the same in structure and effects as the counterparts in the first to fourth embodiments are given the same referential codes as those given to the counterparts, and are not going to be described here. The cartridge and image forming apparatus to which the electrical connector 25 in this embodiment is compatible are the same as those in the first embodiment. Therefore, they are not going to be described here. The electrical connector 25 in the fifth embodiment is different from the electrical connector 21-24 in the first to fourth embodiments in that the electrical connector 25 has a portion 25*e* (protrusion) which protrude from the end of the portion of contact 25*b* toward the shaft 62 in the direction parallel to the axial line L.

The electrical connector 25 is a component that contacts the cylindrical member 7*e* which is electrically conductive and the peripheral surface of which is covered with the photosensitive layer. It has a pair of first portions of contact 21*a* by which it contacts the inward surface of the cylindrical member 7*e*.

Further, the electrical connector 25 is a component that contacts the drum shaft 62 which functions as the "external electrical connector". It has a pair of second portions of contact 25*b* by which it contacts the drum shaft 62 which extends outward of the cylindrical member 7*e*. The electrical connector 25 is made of electrically conductive metallic plate, and is structured as described above to maintain electrical connection between the inward surface of the cylindrical member 7*e* and the outside of the photosensitive drum 507.

Referring to FIGS. 11(*a*)-11(*c*), the electrical connector 25 has the first horizontal portion 21*f*, first vertical portion 21*c*, second horizontal portion 21*g*, and second vertical portion 21*d*. The second vertical portion 21*d* has the second portion of contact 25*b*. The second portion of contact 25*b* has the protrusion 25*e* which extends toward the drum shaft 62. In this embodiment, the drum shaft 62 is employed as the "external electrical connector". The inward end of the drum shaft 62 is flat (flat surface 62*a*). The electrical connector 25 and flange 41 are structured so that the protrusion 25*e* of the second portion of contact 25*b* of the electrical connector 25 contacts this flat surface 62*a* of the drum shaft 62.

In the first to fourth embodiment, the inward end portion 61*a* of the drum shaft 61, by which the drum shaft 61 contacts the electrical connector 21, 22, 23, or 24, was pointed or spherical, whereas the portion of the electrical connector 21, 22, 23, or 24, by which the electrical connector 21, 22, 23, or 24 contacts the drum shaft 61, was flat (second portion of contact 21*b*). In this embodiment, the portion of the electrical connector 25, by which the electrical connector 25 contacts the drum shaft 62, is the horizontal protrusion 25*e* of the electrical connector 25, whereas the portion of the drum shaft 62, by which the drum shaft 62 contacts the electrical connector 25 is the flat surface 62*a* of the inward end of the drum shaft 62. That is, the fifth embodiment is opposite from the first to fourth embodiments in terms of the relationship between the shape of the portion of contact of the electrical connector and the shape of the portion of contact of the drum shaft.

Figure 12:
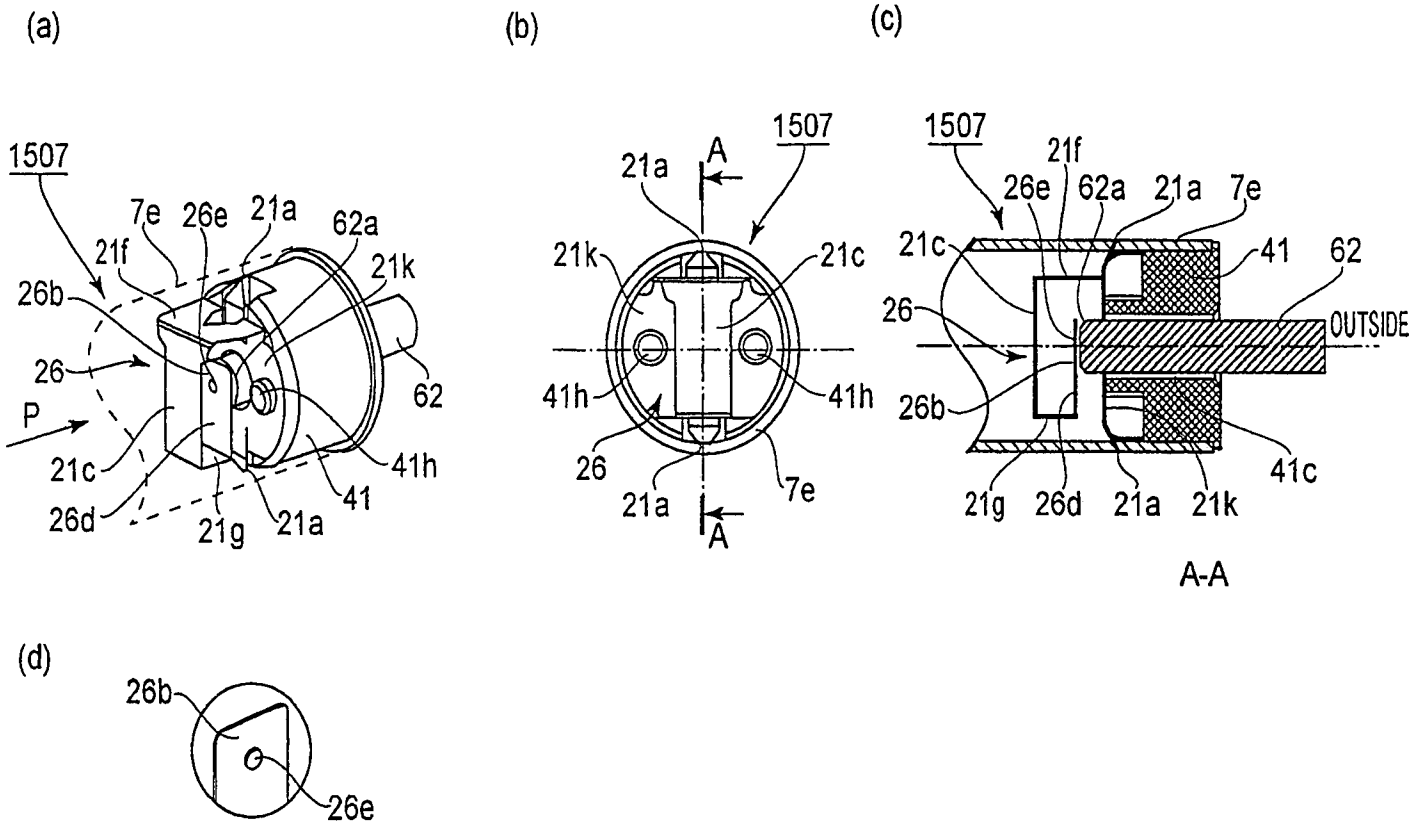
FIG. 12 is a drawing for showing the structure of one of the lengthwise end portions of the photosensitive drum in the modified version of the fifth embodiment, FIGS. 12(*a*), 12(*b*), 12(*c*) and 12(*d*) being a perspective view of the combination of the electrical connector, flange, and drum shaft; a sectional view of the combination of the electrical connector, cylindrical member, and flange, at a plane perpendicular to the axial line of the cylindrical member; a sectional view of the combination of the electrical connector, cylindrical member, flange, and drum shaft, at a plane which coincides with the axial line of the drum shaft; and a perspective view of the tip portion of the portion of contact of the electrical connector, respectively.

FIG. 12(*a*) is a perspective view of the combination of the electrical connector 26, drum shaft 62, and flange 41 in one of the modified versions of the fifth embodiment. It shows the structure of the combination. FIG. 12(*b*) is a plan view of the combination of the cylindrical member 7*e*, electrical connector 26, and flange 41. It also shows the structure of the combination. FIG. 12(*c*) is a sectional view of the right end portion of the photosensitive drum 1507, at the hypothetical plane M. FIG. 12(*d*) is an enlarged perspective view of the protrusion 26*e* of the electrical connector 26. The electrical connector 26 is a component which contacts the cylindrical member 7*e* (which is electrically conductive, and peripheral surface of which is covered with photosensitive layer). It has a pair of first portion of contacts 21*a*, which contact the inward surface of the cylindrical member 7*e*. Further, the electrical connector 26 contacts the drum shaft 62, as the "external electrical connector", which has electrical connection to the outside of the cylindrical member 7*e*. It has the second portion of contact 26*b* which contacts the drum shaft 62, which extends outward of the cylindrical member 7*e*. The electrical connector 26 is made of electrically conductive metallic plate, and is structured as described above so that it maintains electrical connection with the outside of the photosensitive drum 1507.

Referring to FIGS. 12(*a*)-12(*d*), the electrical connector 26 has the first horizontal portion 21*f*, first vertical portion 21*c*, and second horizontal portion 21*g*. Further, the electrical connector 26 has the second vertical portion 26*d*, which extends from the end of the second horizontal portion 21*g* in the direction perpendicular to the axial line L. The second vertical portion 26*d* has the second portion of contact 26*b*, which is provided with the protrusion 26*e* formed by embossing the second portion of contact 26*b*.

Embodiment 6

Figure 13:
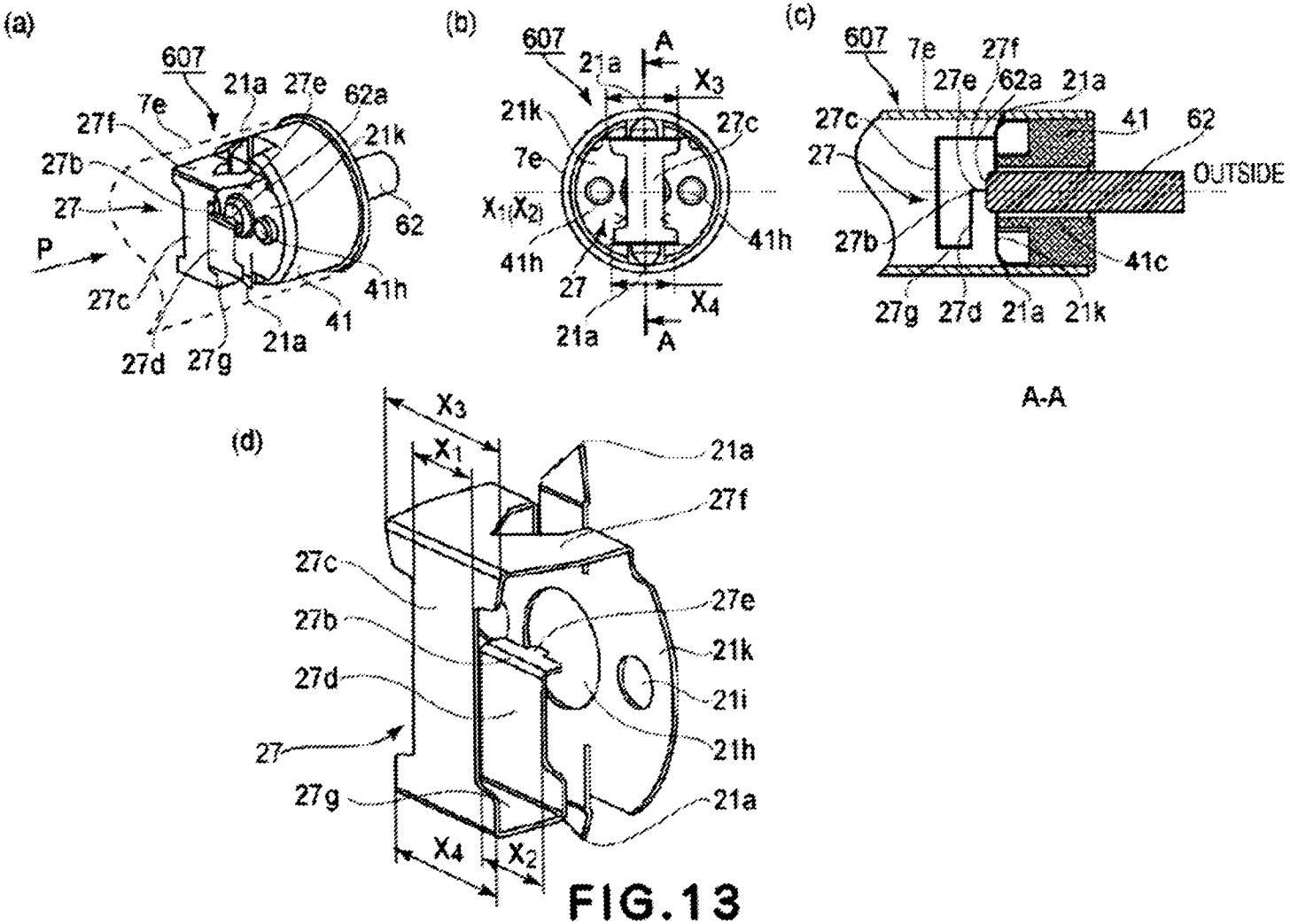
FIG. 13 is a drawing for showing the structure of one of the lengthwise end portion of the photosensitive drum in the sixth embodiment, FIGS. 13(*a*), 13(*b*), 13(*c*) and 13(*d*) being a perspective view of the combination of the electrical contact, flange, and drum shaft; a sectional view of the combination of the electrical connector, cylindrical member, and flange, at a plane perpendicular to the axial line of the cylindrical member; a sectional view of the combination of the electrical contact, cylindrical member, flange, and drum shaft, at a vertical plane which coincides with the axial line of the drum shaft, and a perspective view of the electrical contact; respectively.

FIG. 13(*a*) is a perspective view of the combination of the electrical connector 27, drum shaft 62, and flange 41 in the sixth preferred embodiment of the present invention. It shows the structure of the combination. FIG. 13(*b*) is a plan view of the combination of the cylindrical member 7*e*, electrical connector 27, and flange 41. It shows the structure of the combination. FIG. 13(*c*) is a sectional view of the right end portion of the photosensitive drum 607. It shows the structure of the right end portion. FIG. 13(*d*) is a perspective view of the electrical connector 27, and shows the structure of the electrical connector 27. The structural components of the photosensitive drum 607, cartridge, and image forming apparatus in the sixth embodiment, which are the same in structure and effects as the counterparts in the first to fifth embodiments, are given the same referential codes as those given to the counterparts, one for one, and are not going to be described here. The cartridge and image forming apparatus in the sixth embodiment are the same as those in the first embodiment, and therefore, are not going to be described here. The electrical connector 27 in the sixth embodiment is different from the electrical connectors 21-26 in the first to fifth embodiments in that the first and second vertical portions 27*c* and 27*d* are narrower than the first and second horizontal portions 27*f* and 27*g*.

The electrical connector 27 contacts the cylindrical member 7*e* (which is electrically conductive, and peripheral surface of which has photosensitive layer), and has a pair of first portions of contact 21*a*, by which it contacts the inward surface of the cylindrical member 7*e*. Further, the electrical connector 27 contacts the drum shaft 62, as the "external electrical connector" which extends outward of the cylindrical member 7*e*. It has a second portion of contact 27*b*, with which it contacts the drum shaft 62 which extends outward of the cylindrical member 7*e*. It is made of electrically conductive metallic plate, and is structured so that it maintains electrical connection with the outside.

Referring to FIG. 13, in the following description of the sixth embodiment, the portions of the electrical connector 27, which are parallel to the axial line L will be referred to as the horizontal portions, whereas the portions of the electrical connector 27, which are perpendicular to the axial line L will be referred to as the vertical portions. The first section 21X of the electrical connector 27 comprises the horizontal portion 27*f* and first vertical portion 27*c*. The second section 21Y of the electrical connector 27 comprises the second horizontal portion 27*g* and second vertical portion 27*d*. Further, the first and second vertical portions 27*c* and 27*d* are narrower than the first and second horizontal portions 27*f* and 27*g*.

Referring to FIG. 13(*d*), the electrical connector 27 has the first and second vertical portions 27*c* and 27*d*, which are perpendicular to the axial line L which coincides with the axial line of the cylindrical member 7*e*, and the horizontal portions 27*f* and 27*g* which are parallel to the axial line L. The first and second vertical portions 27*c* and 27*d* are partially narrower than the first and second horizontal portions 27*f* and 27*g*. The electrical connector 27 is made of springy plate, and is structured so that there is the following relationship among the widths X1 and X2 of the first and second vertical portions 27*c* and 27*d*, respectively, and the widths X3 and X4 of the first and second horizontal portions 27*f* and 27*g*, respectively: X1, X2<X3, X4.

Next, referring to FIG. 13(*c*), the first and second vertical portions 27*c* and 27*d* are more likely to resiliently bend (function as springs) in the direction (parallel to axial line L or axial line of cylindrical member 7*e*) in which the second portion of contact 27*b* displaces than the first and second horizontal portions 27*f* and 27*g*. Thus, the electrical connector 27 is structured so that it is easier for the first and second vertical portions 27*c* and 27*d* to resiliently bend (function as springs) than the first and second horizontal portions 27*f* and 27*g*. Thus, electrical connector 27 is more resistant to permanent deformation (plastic deformation), being therefore more stable in electrical connection than the electrical connectors 21-26 in the first to fifth embodiments.

Next, referring to FIG. 13(*b*), the electrical connector 27 is fastened to the flange 41 by the flattening of a pair of connector positioning pins. More specifically, the flange 41 is provided with a pair 41*b* of pins (FIG. 5) which are for positioning the electrical connector 27 relative to the flange 41 and can be thermally flattened. After the electrical connector 27 is properly positioned relative to the flange 41 with the help from the pins 41*b*, the pins 41*b* are flattened into the portions 41*h* (thermally flattened portions) by the pressure applied thereto while the pins 41*b* are kept soft by the application of heat. Incidentally, in a case where a flattening horn is used to flatten the heads of the pins 41*b*, the first and second vertical portions 27*c* and 27*d* may be made narrower than the first and second horizontal portions 27*f* and 27*g* (X1, X2<X3, X4) in order to make it easier to insert the flattening horn.

Embodiment 7

Figure 14:
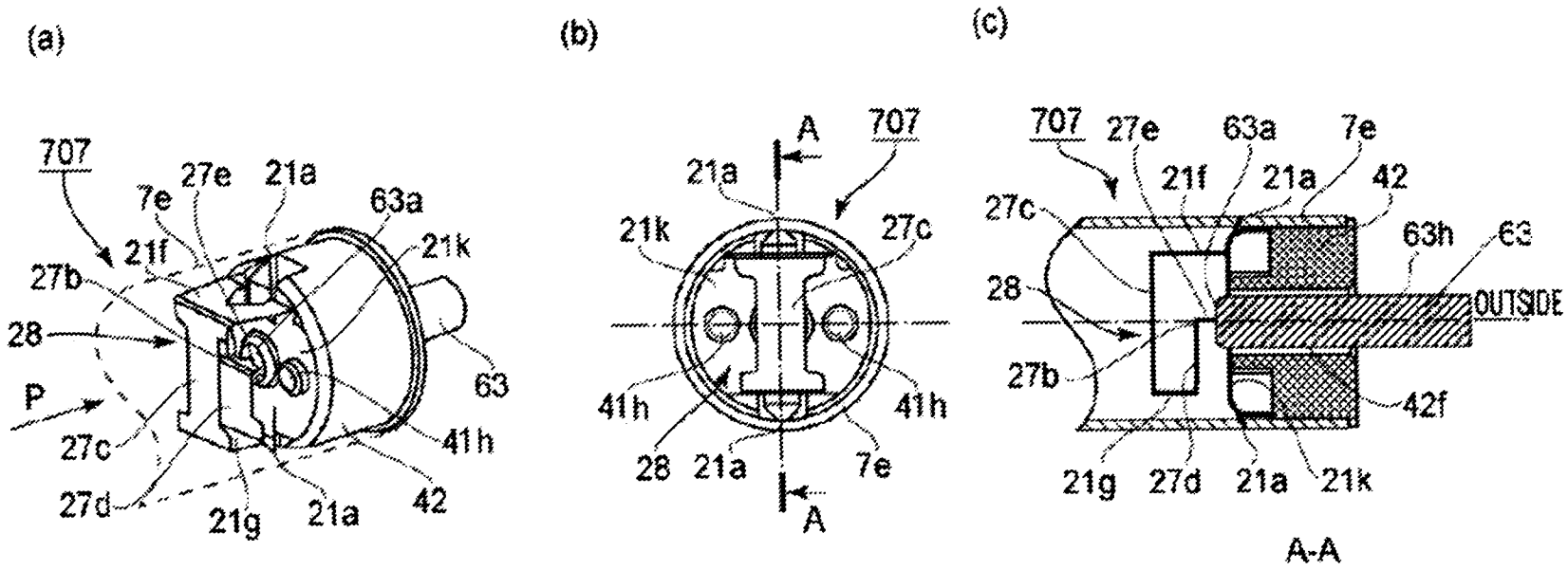
FIG. 14 is a drawing for showing the structure of one of the lengthwise ends of the photosensitive drum in the seventh embodiment, FIGS. 14(*a*), 14(*b*) and 14(*c*) being a perspective view of the combination of the electrical connector, flange, and drum shaft; a sectional view of the combination of the electrical connector, cylindrical member, and the flange at a plane perpendicular to the axial line of the cylindrical member; and a sectional view of the combination of the electrical connector, cylindrical member, flange, and drum shaft, at a vertical plane which coincides with the axial line of the drum shaft, respectively.

FIG. 14(*a*) is a perspective view of the combination of the electrical connector 28, drum shaft 63, and flange 42 in the seventh preferred embodiment of the present invention. It shows the structure of the combination. FIG. 14(*b*) is a plan view of the combination of the cylindrical member 7*e*, electrical connector 28, and flange 42. It shows the structure of the combination. FIG. 14(*c*) is a sectional view of the right end portion of the photosensitive drum 707. It shows the structure of the right end portion. The structural components of the photosensitive drum 707, cartridge, and image forming apparatus in the seventh embodiment, which are the same in structure and effects as the counterparts in the first to sixth embodiments, are given the same referential codes as those given to the counterparts, one for one, and are not going to be described here. The cartridge and image forming apparatus in the seventh embodiment are the same as those in the first embodiment, and therefore, are not going to be described here. The electrical connector 28 and its adjacencies in the seventh embodiment are different from the electrical connector 21-26 and their adjacencies in the first to sixth embodiments is that in this embodiment, the drum shaft 63 is supported by the flange 42 by being fitted in the flange 42. The structure of the electrical connector 28 is the same as that of the electrical connector 27.

Referring to FIG. 14, the electrical connector 28 is a component which contacts the cylindrical member 7*e* (which is electrically conductive, and peripheral surface of which is covered with photosensitive layer). It has a pair of first portions of contact 21*a* which contact the inward surface of the cylindrical member 7*e*. It contacts also the drum shaft 63, as the "external electrical connector", which has electrical connection with the outside of the cylindrical member 7*e*. It has also a second portion of contact 27*b* which contacts the drum shaft 63 which extends outward of the cylindrical member 7*e*. The electrical connector 28 is made of electrically conductive metallic plate, and is structured as described above to maintain electrical connection with the outside.

The flange 42 has a through hole 42*f*, through which the drum shaft 63 (external electrical connector) is put in such a manner that there is virtually not gap between the peripheral surface 63*h* of the drum shaft 63 and the inward surface of the hole 42*f*. In other words, the drum shaft 63 is supported by the flange 42, whereby the both the second portion of contact 27*b* (protrusion 27*e*), and the drum shaft 63 (flat surface 63*a* at the inward end of shaft 63) are properly positioned relative to each other. Therefore, the combination of the electrical connector 28, flange 42, and shaft 63 is more stable in electrical connection than those in the first to sixth embodiments.

The structural arrangement related to the abovementioned combination may be modified so that the drum shaft 63 is fastened to the flange 42 by crimping to make the drum shaft 63 an integral part of the structural component of the photosensitive drum 707, and therefore, the drum shaft 63 rotates with the photosensitive drum 707.

Further, the structural arrangement related to the abovementioned combination may be modified so that the drum shaft 63 is solidly attached to the frame of the cartridge 101 or apparatus main assembly 100A, and a minute gap is present between the peripheral surface of the drum shaft 63 and the internal surface of the hole 42*f* of the flange 42 to rotatably support the photosensitive drum 707 with the drum shaft 63. In such a case, as the photosensitive drum 707 rotates, the protrusion 27*e* of the electrical connector 28 slides on the flat surface 63*a* of the drum shaft 63, maintaining thereby electrical connection between the electrical connector 28 and drum shaft 63. Further, in such a case, the point of contact between the protrusion 27*e* and drum shaft 63 virtually coincides with the rotational axis of the drum shaft 63 (photosensitive drum 707). Therefore, the electrical connector 28 is more stable in electrical connection.

Embodiment 8

Figure 15:
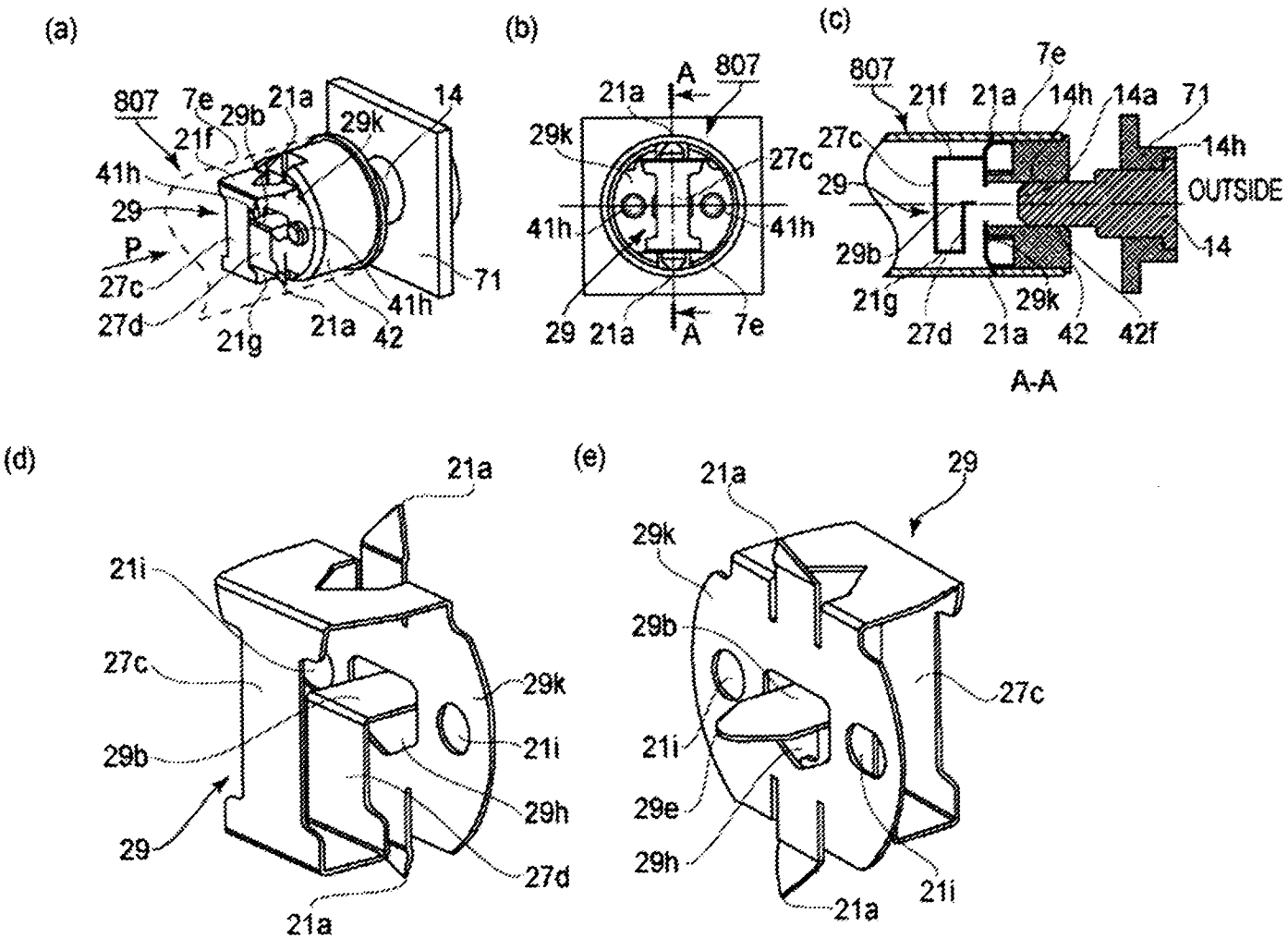
FIG. 15 is a drawing for showing the structure of one of the lengthwise end portions of the photosensitive drum in the eighth embodiment, FIGS. 15(*a*), 15(*b*), 15(*c*), 15(*d*) and 15(*e*) being a perspective view of the combination of the electrical connector, flange, eternal electrical connector, and cartridge frame 71; a plan view of the combination of the electrical connector, cylindrical member, flange, and cartridge frame 71; a sectional view of the combination of the electrical connector, cylindrical member, flange, external electrical connector; and cartridge frame 71, at a vertical plane which coincides with the axial line of the drum shaft; a perspective view of the electrical connector; and a perspective view of the electrical connector, respectively.

FIG. 15(*a*) is a perspective view of the combination of the electrical connector 29, external electrical connector 14, flange 42, and cartridge frame 71 in the eighth preferred embodiment of the present invention. It shows the structure of the combination. FIG. 15(*b*) is a plan view of the combination of the cylindrical member 7*e*, electrical connector 29, and flange 42. It shows the structure of the combination. FIG. 15(*c*) is a sectional view of the right end portion of the photosensitive drum 807. It shows the structure of the right end portion. FIGS. 15(*d*) and 15(*e*) are enlarged perspective views of the electrical connector 29. They show the structure of the electrical connector 29. The structural components of the photosensitive drum 807, cartridge, and image forming apparatus in the eighth embodiment, which are the same in structure and effects as the counterparts in the first to seventh embodiments, are given the same referential codes as those given to the counterparts, one for one, and are not going to be described here. The cartridge and image forming apparatus in the eighth embodiment are the same as those in the first embodiment, and therefore, are not going to be described here. The difference between the electrical connector 29 and its adjacencies in the eighth embodiment, and the electrical connector 21-26 and their adjacencies in the first to seventh embodiments is as follows:

To begin with, the electrical connector 29 has a base section 29*k* by which the electrical connector 29 is fastened to the flange 42. The base section 29*k* has a through hole 29*h*, which is parallel to the axial line L of the cylindrical member 7*e*. The second portion of contact 29*b* of the electrical connector 29 is long enough to extend beyond the base section 29*k*. Further, the external electrical connector 14 is supported by the flanges 42 and cartridge frame 71.

The electrical connector 29 contacts the cylindrical member 7*e* (which is electrically conductive, and peripheral surface of which is covered with photosensitive layer). It has a pair of first portions of contact 21*a* which contact the inward surface of the cylindrical member 7*e*. It contacts also the external electrical connector 14, as the "external electrical connector", which has electrical connection with the outside of the cylindrical member 7*e*. It has also a second portion of contact 29*b* which contacts the external electrical connector 14 which extends outward of the cylindrical member 7*e*. The electrical connector 29 is made of electrically conductive metallic plate, and is structured as described above to maintain electrical connection with the outside.

Referring to FIG. 15(*d*), the electrical connector 29 has the base section 29*k* by which it is fastened to the flange 42. It is structured so that its second portion of contact 29*b* extends toward the external electrical connector 14 beyond the base section 29*k* through the hole 29*h* of the base section 29*k*. Next, referring to FIG. 15(*e*), the end of the second portion of contact 29*b* has a protrusion 29*e*. Next, referring to FIG. 15(*a*), the outward end of the external electrical connector 14 is solidly attached to the frame 71 of the cartridge 101 by being pressed into a hole with which the frame 71 is provided for the external electrical connector 14, or the like method, whereas the inward end portion of the external electrical connector 14 is fitted in the through hole of the flange 42 with the presence of virtually no gap between the peripheral surface of the external electrical connector 14 and the inward surface of the through hole of the flange 42 so that the photosensitive drum 807 is rotatably supported by the external electrical connector 14. In a case where the dimension of the external electrical connector 14 in the direction parallel to the diameter direction of the cylindrical member 7*e* is greater than the dimension of the second portion of contact 29*b* in the same direction, the electrical connector 29 can be made greater in rigidity by putting the second portion of contact 29*b* through the hole 29*h* of the base section 29*k*. Further, the smaller the hole 29*h* of the base section 29*k*, the more rigid the electrical connector 29. In other words, the electrical connector 29 in this embodiment is greater in rigidity, being therefore more resistant to the external load, and therefore, more stable in electrical connector, than the counterparts in the first to seventh embodiments.

In this embodiment, the electrical connector 29 is attached to the cylindrical member 7*e* with the use of the flange 42. However, the present invention is compatible with the electrical connector 29 even if the electrical connector 29 is modified to be directly fastened to the cylindrical member 7*e* (FIGS. 7 and 8). The effects of the modified version of the electrical connector 29 are the same as the original version of the electrical connector 29, which is to be attached to the cylindrical member 7*e* with the use of the flange 42.

Further, the above-described structural arrangement can be used to rotatably support the photosensitive drum 807 with the external electrical connector 14 by solidly supporting the external electrical connector 14 with the frame 71 of the cartridge 101 or the frame (unshown) of the apparatus main assembly 100A, by the peripheral surface 14*h* of the external electrical connector 14 as shown in FIG. 15(*c*). In such a case, as the photosensitive drum 807 rotates, the protrusion 29*e* of the electrical connector 29 slides on the flat surface 14*a* of the inward end of the external electrical connector 14, remaining thereby electrically in connection to the external electrical connector 14. Further, the electrical connector 29 is structured so that the point of contact between the protrusion 29*e* of the electrical connector 29 and the external electrical connector 14 coincides with the rotational axis of the photosensitive drum 808, that is, the rotational axis of the external electrical connector 14. Therefore, the electrical connector 29 in this embodiment is more stable in electrical connector.

According to the first to eighth preferred embodiments, the electrical connector 21-29 have the first and second flexible sections 21X and 21Y formed by putting a strip of electrically conductive springy metallic plate through such processes as bending by 90° or in curvature, doubling back, etc. The first flexible section 21X has the first vertical portion, which extends in the first diameter direction X, whereas the second flexible section 21Y has the second vertical portion which extends in the second diameter direction Y across the axial line L. Therefore, the electrical connector 21-29 to which the contact pressure between the external electrical connector 14 and second portion of contact of each of the electrical connector 21-29, or the drum shaft 61, 62, or 63 and the second portion of the contact can be made longer. Therefore, not only can the electrical connector 21-29 provide a contact pressure which is greater than a preset value, between the external electrical connector 14 and themselves, or between the drum shaft 61, 62, 63, or 64 and themselves, but also, are substantially more resistant to the permanent deformation (plastic deformation). Therefore, they are more stable in terms of the electrical connection between themselves and the external electrical connector 14 or drum shaft 61, 62, 63, or 64, being therefore superior in terms of the release of the residual electrical charge of the photosensitive drum 7, 207, 307, 407, 507, 1507, 607, 707, or 807, to the apparatus main assembly 100A, than any of the conventional counterparts. Therefore, they ensure that an image forming apparatus outputs excellent prints.

Referring to FIG. 6(*c*), in the first embodiment, the electrical connector 21 is structured so that the first and second vertical portions 21*c* and 21*d* extend in the first and second diameter directions X and Y, respectively, which is parallel to the hypothetical plane M which coincides with the axial line of the cylindrical member 7*e*. This structural arrangement is most effective to prevent the second portion of contact 21*b* from being displaced in the direction perpendicular to the axial line L.

Next, referring to FIG. 6(*b*), also in the first embodiment, the electrical connector 21 is structured so that the second vertical portion 21*d* of the electrical connector 21 is created by bending the second horizontal portion 21*g* in the opposite direction from the direction in which the first horizontal portion 21*f* is bent to form the first vertical portion 21*c*. This structural arrangement is very useful to create an electrical connector such as the electrical connector 21 which is substantial in length, and yet, can be placed in a small space.

Further, in the first to eighth embodiments, the electrical connectors 21-28 are structured so that the centerline of the second portion of contact virtually coincides with the hypothetical plane M. In other words, the center line of the second portion of contact, centerline of the first vertical portions 21*c*, and centerline of the second vertical portion 21*d* virtually coincide with the hypothetical plane M. Thus, as the second portion of contact displaces in the direction parallel to the axial line L, the first and second vertical portions 2*c* and 2*d* deform, accommodating thereby the movement (displacement) of the second portion of contact in the direction parallel to the axial line L. Therefore, the electrical connector 21-28 are minimized in terms of the distance by which the point of contact between the second portion of contact and the external electrical connector 14, and the point of contact between the second portion of contact and the drum shafts 61, 62, 63, or 64, moves in the direction perpendicular to the axial line of the cylindrical member 7*e*; the displacement of the second portion of contact and drum shaft relative to each other is minimized. In other words, from the stand point of the design of the electrical connector, the second portion of contact and its area of contact does not need to be as large as the counterparts of the conventional electrical contact for a photosensitive drum, making it possible to reduce the electrical connector in cost.

For example, in the first to eighth embodiments, the electrical connectors 21-28 are structured so that the second portion of contact intersects with the axial line L. Therefore, as the second portion of contact slides on the external electrical connector 14, drum shaft 61, 62, 63, or 64, the point of contact remains on the rotational axis of the cylindrical member. Therefore, the electrical connector 21-28 are more stable in terms of the electrical connection between the second portion of contact and the external electrical connector 14, drum shaft 61, 62, 63 or 64 than the conventional counterparts.

According to the structural arrangement (FIG. 7) for the electrical contact in the second embodiment, not only can the same effects as those provided by that in the first embodiment be provided, but also, the flange 41, etc., can be eliminated. In other words, it can reduce an image forming apparatus, a process cartridge, etc., in component count, and therefore, can reduce them in cost.

According to the structural arrangement (FIG. 9) for the electrical connector 23 in the third embodiment, the first "flexible" portion 23*c* is semicircular. However, the effects of this structural arrangement are the same as those obtainable by the structural arrangement for the electrical connector 21 in the first embodiment. Incidentally, the second "flexible" portion does not need to be semicircular. That is, it may be in any form, as long as it extends in the direction perpendicular to the axial line L across the axial line L.

According to the structural arrangement (FIG. 10) for the electrical connector 24 and its adjacencies in the fourth embodiment, the direction in which the electrical connector 24 extends is opposite to the direction in which the electrical connector 21 in the first embodiment does. However, the effect of this structural arrangement is the same as those obtainable by the electrical connector 21 in the first embodiment. That is, the direction in which the various portions of the electrical connector is to be bent in a manner of doubling back is optional, and so is the combination in which the various portions of the electrical connector are bent in a manner of doubling back. All that is necessary is that the electrical connector is shaped so that the first vertical portion 24*c* extends perpendicular to the axial line L across the axial line L within the cylindrical member 7*e*, and the second vertical portion 24*d* also extends perpendicular to the axial line L across the axial line L in a manner of doubling back relative to the first vertical portion 24*c*, within the cylindrical member 7*e*.

Further, the electrical connector may be shaped so that a pair of portions of the electrical connector other than the combination of the first and second vertical portions 24*c* and 24*d* are parallel to each other and extend in a manner of doubling back relative to each other. For example, the electrical connector may be shaped so that the base section 21*k* and first vertical portion 24*c* are parallel to each other and extend in a manner of doubling back relative to each other. Further, it is desired that not only the electrical connector is shaped as described above in terms of the "doubling back", but also, the pair of portions which extend in a manner of doubling back relative to each other are parallel to the first or second diameter direction X or Y and extend across the axial line L of the cylindrical member 7*e*. This structural arrangement is superior in terms of the minimization of the movement of the second portion of contact 24*b* in the diameter direction of the cylindrical member 7*e*.

According to the structural arrangement (FIGS. 11 and 12) for the electrical connector 25 and 26 in the fifth embodiment, the second portions of contact 25*b* and 26*b* have the protrusions 25*e* and 26*e*, respectively, which are protrusive toward the drum shaft 62. That is, the electrical connector 25 and 26 are provided with a specific point of contact, with which they contact the drum shaft 62. Therefore, they are more stable in terms of electrical connection. Further, the second portions of contacts 25*b* and 26*b* themselves do not function as a spring. Therefore, even in consideration of the errors in the manufacturing of an electrical connector, the area of the electrical connector 25 and that of the electrical connector 26, by which the electrical connector 25 and 26 contact the drum shaft 62 may be smaller than the counterparts in the first to fourth embodiments. In other words, this structural arrangement can afford more latitude in the control of the manufacturing process for an electrical connector. Therefore, it makes it easier to manufacture an electrical connector.

According to the structural arrangement (FIG. 13) for the electrical connector 27 in the sixth embodiment, the electrical connector 27 has the horizontal portions 27*f* and 27*g*, and the first and second vertical portions 27*c* and 27*d*. Further, the electrical connector 27 is structured so that the first and second vertical portions 27*c* and 27*d* are partially narrower than the horizontal portions 27*f* and 27*g*. Therefore, the first and second vertical portions 27*c* and 27*d*, which are to function as a spring, are more flexible in the direction in which the second portion of contact 27*b* displaces. Therefore the horizontal portions 27*f* and 27*g* which are not to function as a spring are unlikely to bend. Thus, the electrical connector 27 in the sixth embodiment is more resistant to the permanent deformation (plastic deformation) than the electrical connector in the first to sixth embodiments.

Also referring to FIG. 13, this structural arrangement makes it possible to move a flattening horn toward the positioning pins 41*b* in a straight line indicated by an arrow mark P when thermally flattening the head portions of the positioning pins 41*b*. That is, this structural arrangement can provide a space through which a flattening horn can be easily inserted. That is, this structural arrangement makes it possible to more reliably fasten an electrical connector to the flange 41. Thus, not only is the electrical connector 27 in this embodiment more stable in electrical connection, but also, easier to attach to the flange 41.

According to the structural arrangement (FIG. 14) for the electrical connector 28 and its adjacencies in the seventh embodiment, the drum shaft 63 is supported by the flange 42. Therefore, the positional relation between the second portion of contact 27*b* and drum shaft 63 is determined by the flange 42, whereby the second portion of contact 27*b* and drum shaft 63 are positioned more precisely positioned relative to each other than the counterparts in the first to seventh embodiments. Therefore, the cartridge and image forming apparatus in this embodiment are more stable in electrical connection.

According to the structural arrangement (FIG. 15) for the electrical connector 29 and its adjacencies in the eighth embodiment, the electrical connector 29 has the base section 29*k*, and the second portion of contact 29*b* extends toward the drum shaft 63 through the hole of the base section 29*k*. Further, in a case where the diameter of the drum shaft 63 is greater than the dimension of the second portion of contact 29*b* in terms of the diameter direction of the cylindrical member 7*e*, not only can the hole, with which the base section 29*k* of the electrical connector 29 has to provided, be minimized in diameter by putting the second portion of contact 29*b*, which is narrower than the diameter of the drum shaft 63, through the hole of the electrical connector 29, but also, the electrical contact 29 can be made more rigid. That is, the structural arrangement for the electrical connector 29 in the eighth embodiment can make an electrical connector easier to handle during the manufacturing of the cartridge 101 and image forming apparatus 100, and also, can make an electrical connector more stable in electrical connection.

Further, the drum shaft 63 is supported by the flange 42. Thus, the positional relationship between the second portion of contact 29*b* and drum shaft 63 is determined by the flange 42. Therefore, the second portion of contact 29*b* and drum shaft 63 are more precisely positioned relative to each other. In other words, this structural arrangement can make the cartridge and image forming apparatus more stable in electrical connection than those in the first to seventh embodiments.

The first and second portions of contact 21*a* and 21*b* of each of the electrical connector 21-29, and the first and second sections 21X and 21Y of each of the electrical connectors 21-29, in the first to eighth embodiments, respectively, are formed of a single piece of plate spring, being therefore smaller in component count, and therefore, smaller is the number of assembly steps, compared to electrical connectors made of two or more components.

In the first, third, fifth, sixth, seventh, and eighth embodiments, and modified version of the fifth embodiment, the electrical connector 21-29 are fastened to the flange 41 or 42, and the flanges 41 and 42 are fastened to one of the lengthwise ends of the cylindrical member 7*e*. This structural arrangement makes it possible for the electrical connector 21-29 to be attached to the cylindrical member 7*e* after being fastened to the flange 41 or 42, which is rigid. Thus, this structural arrangement is superior in terms of assembly efficiency than the structural arrangement for the electrical connector 21-29 and their adjacencies, which requires the electrical connector 21-29 to be directly attached to the cylindrical member 7*e*.

In the seventh and eighth embodiments, the cartridge has a photosensitive drum, and the "external electrical connector" of the cartridge is the drum shaft 63 or external electrical connector 14, which is electrically conductive. Further, the photosensitive drum is rotatably supported by the drum shaft 63 or external electrical connector 14, with the presence of the flange 41 or 42 between the cylindrical member 7*e* and drum shaft 63 or external electrical connector 14. This structural arrangement makes it possible for the drum shaft 63 or external electrical connector 14 to support the photosensitive drums 7, 207, 307, 407, 507, 1507, 607, 707, and 808 while functioning as an electrical connector. Further, this structural arrangement makes the point of contact between an electrical connector and a drum shaft or external electrical connector coincides with the axial line of the drum shaft or external electrical connector. Therefore, it can make a process cartridge and an image forming more stable in electrical connection than those in the other embodiments.

The electrical connector 21-29 in the first to eighth embodiments, respectively, are compatible with the photosensitive drums 7, 207, 307, 407, 507, 1507, 607, 707, and 807. Further, these photosensitive drums are compatible with various cartridges such as the cartridge 101, which are compatible with various image forming apparatuses such as the image forming apparatus 100. The effects of the application of the electrical connector 21-29 to the various photosensitive drums, cartridges, image forming apparatuses are the same as those obtained in the first to eighth embodiments.

Further, in the first to eighth embodiments, each electrical connector is structured so that it has two vertical portions. However, these embodiments are not intended to limit the present invention in terms of the number of the vertical portions of an electrical connector. That is, the number of the vertical portions of an electrical connector may be three or more.

As described above, according to the present invention, an electrical connector for an electrophotographic photosensitive drum, which contributes to the contact pressure between itself and the external electrical connector, is structured so that its first and second vertical portions, which function as springs, extend in the diameter direction of the photosensitive drum. Thus, not only can it be placed in the limited internal space of the cylindrical member of the photosensitive drum, but also, it is significantly longer, being therefore more stable in electrical connection (contact pressure), than a conventional electrical connector for an electrophotographic photosensitive drum. That is, the present invention can provide an electrical connector for an electrophotographic photosensitive drum, which is stable in the amount of contact pressure between its second portion of contact and an external electrical connector, and highly resistant to permanent deformation (plastic deformation). In other words, the present invention can provide an electrical connector for an electrophotographic photosensitive drum, which is significantly more stable in electrical connection than a conventional electrical connector for an electrophotographic photosensitive drum.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 192104/2010 filed Aug. 30, 2010 which is hereby incorporated by reference.

What is claimed is:

1. An electrical contact member for electrically connecting to an external contact which is electrically connected with an electroconductive cylindrical member having a photosensitive layer on an outer surface thereof and which is provided outside the cylindrical member, said electrical contact member comprising:

a base portion;

a first contact portion provided on said base portion and contacted with the cylindrical member;

a second contact portion contacted with the external contact;

a first extension connected electrically with said base portion and extending in a diametrical direction across a rotational axis of the cylindrical member; and a second extension electrically connecting with said first extension and extending in the diametrical direction toward the axis, said second extension being provided with said second contact portion, wherein when said second contact portion is contacted by the external contact, said second contact portion displaces along the axis, and wherein said second contact portion is provided between said base portion and said first extension in the direction of the axis, and said base portion is provided with a hole through which the external contact in the form of a shaft penetrates.

2. The electrical contact member according to claim 1, wherein said second contact portion has a projection projecting toward the external contact.

3. The electrical contact member according to claim 1, wherein a connecting portion extends along the axis to electrically connect said base portion with said first extension.

4. The electrical contact member according to claim 1, wherein said first extension has a width which is smaller than that of a connecting portion that electrically connects said base portion with said first extension.

5. The electrical contact member according to claim 1, wherein said first contact portion, said second contact portion, and said second extension are portions of a molded leaf spring.

6. An electrical contact member for electrically connecting to an external contact which is electrically connected with an electroconductive cylindrical member having a photosensitive layer on an outer surface thereof and which is provided outside the cylindrical member, said electrical contact member comprising:

a base portion;

a first contact portion provided on said base portion and contacted with the cylindrical member;

a second contact portion contacted with the external contact;

a first extension connected electrically with said base portion and extending in a diametrical direction across a rotational axis of the cylindrical member; and a second extension electrically connecting with said first extension and extending in the diametrical direction toward the axis, said second extension being provided with said second contact portion, wherein when said second contact portion is contacted by the external contact, said second contact portion displaces along the axis, and wherein said base portion is provided with a hole through which said second contact portion penetrates.

7. The electrical contact member according to claim 6, wherein said second contact portion has a projection projecting toward the external contact.

8. The electrical contact member according to claim 6, wherein a connecting portion extends along the axis to electrically connect said base portion with said first extension.

9. The electrical contact member according to claim 6, wherein said first extension has a width which is smaller than that of a connecting portion that electrically connects said base portion with said first extension.

10. The electrical contact member according to claim 6, wherein said first contact portion, said second contact portion, and said second extension are portions of a molded leaf spring.

11. An electrophotographic photosensitive drum usable with an electrophotographic image forming apparatus, said electrophotographic photosensitive drum comprising:

(i) an electroconductive cylindrical member having a photosensitive layer on an outer surface thereof; and (ii) an electrical contact member electrically connected with said cylindrical member and electrically connected with an external contact outside said cylindrical member, the electrical contact member comprising:

a base portion;

a first contact portion provided on said base portion and contacted with said cylindrical member;

a second contact portion contacted with the external contact;

a first extension connected electrically with said base portion and extending in a diametrical direction across a rotational axis of said cylindrical member; and a second extension electrically connecting with said first extension and extending in the diametrical direction toward the axis, said second extension being provided with said second contact portion, wherein when said second contact portion is contacted by the external contact, said second contact portion displaces along the axis, and wherein said second contact portion is provided between said base portion and said first extension in the direction of the axis, and said base portion is provided with a hole through which the external contact in the form of a shaft penetrates.

12. The electrophotographic photosensitive drum according to claim 11, wherein said second contact portion has a projection projecting toward the external contact.

13. The electrophotographic photosensitive drum according to claim 11, wherein a connecting portion extends along the axis to electrically connect said base portion with said first extension.

14. The electrophotographic photosensitive drum according to claim 11, wherein said first extension has a width which is smaller than that of a connecting portion that electrically connects said base portion with said first extension.

15. The electrophotographic photosensitive drum according to claim 11, wherein said first contact portion, said second contact portion, and said second extension are portions of a molded leaf spring.

16. The electrophotographic photosensitive drum according to claim 11, further comprising a flange member which is fixed to one longitudinal end of said cylindrical member and to which said electrical contact member is fixed.

17. The electrophotographic photosensitive drum according to claim 16, wherein said flange member supports the external contact.

18. An electrophotographic photosensitive drum usable with an electrophotographic image forming apparatus, said electrophotographic photosensitive drum comprising:

(i) an electroconductive cylindrical member having a photosensitive layer on an outer surface thereof; and (ii) an electrical contact member electrically connected with said cylindrical member and electrically connected with an external contact outside said cylindrical member, the electrical contact member comprising:

a base portion;

a first contact portion provided on said base portion and contacted with said cylindrical member;

a second contact portion contacted with the external contact;

a first extension connected electrically with said base portion and extending in a diametrical direction across a rotational axis of said cylindrical member; and a second extension electrically connecting with said first extension and extending in the diametrical direction toward the axis, said second extension being provided with said second contact portion, wherein when said second contact portion is contacted by the external contact, said second contact portion displaces along the axis, and wherein said base portion is provided with a hole through which said second contact portion penetrates.

19. The electrophotographic photosensitive drum according to claim 18, wherein said second contact portion has a projection projecting toward the external contact.

20. The electrophotographic photosensitive drum according to claim 18, wherein a connecting portion extends along the axis to electrically connect said base portion with said first extension.

21. The electrophotographic photosensitive drum according to claim 18, wherein said first extension has a width which is smaller than that of a connecting portion that electrically connects said base portion with said first extension.

22. The electrophotographic photosensitive drum according to claim 18, wherein said first contact portion, said second contact portion, and said second extension are portions of a molded leaf spring.

23. The electrophotographic photosensitive drum according to claim 18, further comprising a flange member which is fixed to one longitudinal end of said cylindrical member and to which said electrical contact member is fixed.

24. A process cartridge detachably mountable to an image forming apparatus, said process cartridge comprising:

an electrophotographic photosensitive drum including (i) an electroconductive cylindrical member having a photosensitive layer on an outer surface thereof; and (ii) an electrical contact member electrically connected with said cylindrical member and electrically connected with an external contact outside said cylindrical member, said electrical contact member comprising:

a base portion;

a first contact portion provided on said base portion and contacted with said cylindrical member;

a second contact portion contacted with the external contact;

a first extension connected electrically with said base portion and extending in a diametrical direction across a rotational axis of said cylindrical member; and a second extension electrically connecting with said first extension and extending in the diametrical direction toward the axis, said second extension being provided with said second contact portion, wherein when said second contact portion is contacted by the external contact, said second contact portion displaces along the axis, and wherein said second contact portion is provided between said base portion and said first extension in the direction of the axis, and said base portion is provided with a hole through which the external contact in the form of a shaft penetrates.

25. The process cartridge according to claim 24, wherein said second contact portion has a projection projecting toward the external contact.

26. The process cartridge according to claim 24, wherein a connecting portion extends along the axis to electrically connect said base portion with said first extension.

27. The process cartridge according to claim 24, wherein said first extension has a width which is smaller than that of a connecting portion that electrically connects said base portion with said first extension.

28. The process cartridge according to claim 24, wherein said first contact portion, said second contact portion, and said second extension are portions of a molded leaf spring.

29. The process cartridge according to claim 24, further comprising a flange member which is fixed to one longitudinal end of said cylindrical member and to which said electrical contact member is fixed.

30. The process cartridge according to claim 29, wherein said flange member supports the external contact.

31. A process cartridge detachably mountable to an image forming apparatus, said process cartridge comprising:

an electrophotographic photosensitive drum including (i) an electroconductive cylindrical member having a photosensitive layer on an outer surface thereof; and (ii) an electrical contact member electrically connected with said cylindrical member and electrically connected with an external contact outside said cylindrical member, said electrical contact member comprising:

a base portion;

a first contact portion provided on said base portion and contacted with said cylindrical member;

a second contact portion contacted with the external contact;

a first extension connected electrically with said base portion and extending in a diametrical direction across a rotational axis of said cylindrical member; and a second extension electrically connecting with said first extension and extending in the diametrical direction toward the axis, said second extension being provided with said second contact portion, wherein when said second contact portion is contacted by the external contact, said second contact portion displaces along the axis, and wherein said base portion is provided with a hole through which said second contact portion penetrates.

32. The process cartridge according to claim 31, wherein said second contact portion has a projection projecting toward the external contact.

33. The process cartridge according to claim 31, wherein a connecting portion extends along the axis to electrically connect said base portion with said first extension.

34. The process cartridge according to claim 31, wherein said first extension has a width which is smaller than that of a connecting portion that electrically connects said base portion with said first extension.

35. The process cartridge according to claim 31, wherein said first contact portion, said second contact portion, and said second extension are portions of a molded leaf spring.

36. The process cartridge according to claim 31, further comprising a flange member which is fixed to one longitudinal end of said cylindrical member and to which said electrical contact member is fixed.

* * * * *